US012320049B2

(12) United States Patent
Detty et al.

(10) Patent No.: US 12,320,049 B2
(45) Date of Patent: Jun. 3, 2025

(54) ADVANCED STITCH PLACEMENT WITH BACKING SHIFTING

(71) Applicant: Tuftco Corporation, Chattanooga, TN (US)

(72) Inventors: Jason Daniel Detty, Chattanooga, TN (US); Robert A. Padgett, Chattanooga, TN (US); Michael R. Morgante, Chattanooga, TN (US); Paul E. Beatty, Chattanooga, TN (US); Steven L. Frost, Chattanooga, TN (US)

(73) Assignee: Tuftco Corporation, Chattanooga, TN (US)

( * ) Notice: Subject to any disclaimer, the term of this patent is extended or adjusted under 35 U.S.C. 154(b) by 1031 days.

(21) Appl. No.: 16/995,805

(22) Filed: Aug. 17, 2020

(65) Prior Publication Data

US 2021/0047764 A1 Feb. 18, 2021

Related U.S. Application Data

(60) Provisional application No. 62/886,970, filed on Aug. 15, 2019.

(51) Int. Cl.

| | |
|---|---|
| ***D05C 15/30*** | (2006.01) |
| ***D05B 19/14*** | (2006.01) |
| ***D05B 19/16*** | (2006.01) |
| ***D05B 39/00*** | (2006.01) |
| ***D05C 17/02*** | (2006.01) |
| *D05B 69/12* | (2006.01) |

(52) U.S. Cl.

CPC ..... *D05B 19/14* (2013.01); *D05B 19/16* (2013.01); *D05B 39/00* (2013.01); *D05C 17/02* (2013.01); *D05B 69/12* (2013.01)

(58) Field of Classification Search

CPC ..... D05C 15/10; D05C 15/14; D05C 15/20; D05C 15/26; D05C 15/28; D05C 15/30

See application file for complete search history.

(56) References Cited

U.S. PATENT DOCUMENTS

| | | | | |
|---|---|---|---|---|
| 2014/0331906 | A1* | 11/2014 | Hall | D05C 15/08 112/80.23 |
| 2016/0289880 | A1* | 10/2016 | Hall | D05C 15/32 |
| 2017/0096757 | A1* | 4/2017 | Hall | D05C 15/08 |

* cited by examiner

*Primary Examiner* — Nathan E Durham

(74) *Attorney, Agent, or Firm* — Miller & Martin PLLC

(57) ABSTRACT

A shiftable backing feed and shiftable needle assembly is utilized with a tufting machine having reciprocating needles and gauge parts for seizing or cutting yarns wherein marginal step yarn placement techniques can be utilized in connection with a row of needles to minimize over-sewing needle positioning, and three axis shifting may be employed to optimize stitch locations in the backing fabric.

19 Claims, 21 Drawing Sheets

| | | | |
|---|---|---|---|
| Machine Gauge | 1/10 | End | 1 |
| Sew Gauge | 1/10 | Ends | 6 |
| Threadup | abcd | Length | 21 |
| Switch Rate | 4400 | Hide Threads | |
| Custom Shift | 0,1,2,3,4,3,2,1 | Needlebar Offset | 1/4 |
| Pattern Language | | | |
| Show Lines | ☑ | Show Grid | ☑ |

| | |
|---|---|
| Standard | Align Last to Next Step |
| Oscillating Base | Align First to Next Step |
| Align Last Step | Sliding First Step Shift |
| Align First Step | |

| | | | |
|---|---|---|---|
| Machine Gauge | 1/10 | End | 1 |
| Sew Gauge | 1/10 | Ends | 20 |
| Hook Gauge | 1/5 | Steps | 30 |
| Switch Rate | 30 | Threadup | abc |
| Needlebar Offset | 1/4 | Hide Threads | |
| Cloth Shift | 0,1,2,3,2,1,2,3,4,3,2,1 | Gauge Steps | |
| Front Shift | | Front Marginal Step | |
| Back Shift | | Back Marginal Step | |
| Intended Shift | | Needlebar Layout | 1:F,1:B |
| Show Lines | ☑ | Show Grid | ☐ |

| | | | |
|---|---|---|---|
| Machine Gauge | 1/10 | End | 1 |
| Sew Gauge | 1/10 | Ends | 20 |
| Hook Gauge | 1/5 | Steps | 30 |
| Switch Rate | 30 | Threadup | abc |
| Needlebar Offset | 1/4 | Hide Threads | ad |
| Cloth Shift | 0,1,2,3,2,1,2,3,4,3,2,1 | Gauge Steps | |
| Front Shift | | Front Marginal Step | |
| Back Shift | | Back Marginal Step | |
| Intended Shift | | Needlebar Layout | 1:F,1:B |
| Show Lines | ☑ | Show Grid | ☐ |

| | | | |
|---|---|---|---|
| Machine Gauge | 1/10 | End | 1 |
| Sew Gauge | 1/10 | Ends | 20 |
| Hook Gauge | 1/5 | Steps | 30 |
| Switch Rate | 30 | Threadup | abc |
| Needlebar Offset | 1/4 | Hide Threads | ad |
| Cloth Shift | 0,1 | Gauge Steps | |
| Front Shift | 2,1,1,0,0,0,1,1,1,0,1,1 | Front Marginal Step | |
| Back Shift | 0,0,1,1,1,0,1,1,2,1,1,0 | Back Marginal Step | |
| Intended Shift | 0,1,2,3,2,1,2,3,4,3,2,1 | Needlebar Layout | 1:F,1:B |
| Show Lines | ☑ | Show Grid | ☐ |

| | | | |
|---|---|---|---|
| Machine Gauge | 1/10 | End | 1 |
| Sew Gauge | 1/10 | Ends | 20 |
| Hook Gauge | 1/5 | Steps | 30 |
| Switch Rate | 30 | Threadup | abc |
| Needlebar Offset | 1/4 | Hide Threads | ac |
| Cloth Shift | | Gauge Steps | |
| Front Shift | 2,1,1,0,0,0,1,1,1,0,1,1 | Front Marginal Step | |
| Back Shift | 0,0,1,1,1,0,1,1,2,1,1,0 | Back Marginal Step | |
| Intended Shift | | Needlebar Layout | 1:F,1:B |
| Show Lines | ☑ | Show Grid | ☐ |

| | | | |
|---|---|---|---|
| Machine Gauge | 1/10 | End | 1 |
| Sew Gauge | 1/14 | Ends | 20 |
| Hook Gauge | 1/5 | Steps | 30 |
| Switch Rate | 30 | Threadup | abc |
| Needlebar Offset | 1/4 | Hide Threads | ac |
| Cloth Shift | 0,1 | Gauge Steps | |
| Front Shift | 2,1,1,0,0,0,1,1,1,0,1,1 | Front Marginal Step | |
| Back Shift | 0,0,1,1,1,0,1,1,2,1,1,0 | Back Marginal Step | |
| Intended Shift | | Needlebar Layout | 1:F,1:B |
| Show Lines | ☑ | Show Grid | ☐ |

ADVANCED STITCH PLACEMENT WITH BACKING SHIFTING

The present application claims priority to U.S. Provisional Patent Application No. 62/886,970 filed Aug. 15, 2019.

FIELD OF THE INVENTION

This invention relates to tufting machines and more particularly to a method for placing needle penetrations while shifting the backing fabric during tufting in a fashion that can allow for a high density of needle penetrations in the backing fabric from a plurality of rows of needles, utilizing stitch placements that can minimize sew-throughs or over-sewing and that can optimize yarn tuft placements for even coverage with minimal backstitch yarn usage.

BACKGROUND OF THE INVENTION

In the production of tufted fabrics, a plurality of spaced yarn carrying needles extend transversely across the machine and are reciprocated cyclically to penetrate and insert pile into a backing material fed longitudinally beneath the needles. During each penetration of the backing material a row of pile is produced transversely across the backing. Successive penetrations result in longitudinal columns of pile tufts produced by each needle. This basic method of tufting limits the aesthetic appearance of tufted fabrics. Thus, the prior art has developed various procedures for initiating relative lateral movement between the backing material and the needles in order to laterally displace longitudinal rows of stitching and thereby create various pattern effects, to conceal and display selected yarns, to selectively cut loops of yarn, to break up the unattractive alignment of the longitudinal rows of tufts, and to reduce the effects of streaking which results from variations in coloration of the yarn.

The tufting industry has long sought easy and efficient methods of producing new visual patterns on tufted fabrics. In particular, the industry has sought to tuft multiple colors so that any selected yarns of multiple colors could be made to appear in any desired location on the fabric. Significant progress toward the goal of creating carpets and tufted fabrics selectively displaying one of a plurality of yarns came with the introduction of a servo motor driven yard feed attachments. Notable among these attachments are the servo scroll attachment described in Morgante, U.S. Pat. No. 6,224,203 and related patents; the single end servo scroll of Morgante, U.S. Pat. No. 6,439,141 and related patents; and the double end servo scroll of Frost, U.S. Pat. No. 6,550,407.

In operation the servo scroll yarn feed attachment, when alternating needles are threaded with A and B yarns respectively, allows the control of tufting of heights of yarns so that at a given location on the surface of the tufted fabric, either or both of the A and B yarns may be visible. However, a servo scroll yarn feed carries several yarns on each servo driven yarn feed roll so that the pattern must repeat several times across the width of the fabric and a yarn tube bank must be used to distribute the yarns. The implementation of the single end scroll pattern attachment, and the similar double end servo scroll pattern attachment, permitted the tufting machine to be configured with A and B yarns fed to alternating needles on a front needle bar while C and D yarns were fed to alternating needles on a rear needle bar in order to create color representations on tufted fabrics.

The single end scroll yarn feed could create patterns that extended across the entire width of the backing fabric.

However, in the four-color application described above, these efforts require that if a solid area of one color is to be displayed, only one of every four stitches is tufted to substantial height and the remaining three colors were "buried" by tufting the corresponding yarn bights to an extremely low height or removing the buried tufts from the backing entirely. With only one of four stitches emerging to substantial height above the backing fabric it is generally necessary to compensate by slowing the backing fabric feed to make multiple penetrations of the backing within the longitudinal progression of a single gauge length so that the resulting tufted fabric has adequate face yarn, although without proper optimization excessive yarn may be "wasted" on the back of the greige due to the increased number and lateral displacement of backstitches. A technique that failed to optimize backstitch yarns was described in U.S. Pat. No. 8,141,505 to Hall.

The principal alternative to these servo yarn drive configurations has been the use of a pneumatic system to direct one of a plurality of yarns through a hollow needle on each penetration of the backing fabric, as typified by U.S. Pat. No. 4,549,496. Such hollow needle, pneumatic tufting machines were traditionally most suitable for producing cut pile tufted fabrics and have been subject to limitations involving the sizes of fabrics that can be tufted, the production speed for those fabrics, and the maintenance of the tufting machines due to the mechanical complexity attendant to the machines' operation. Accordingly, the tufting industry has had a long felt need for a tufting machine that could operate efficiently to display one of several yarns at a selected location in either cut or loop pile, while maintaining a suitable density of face yarns and an output of tufted fabrics at speeds approaching those of conventional tufting machines.

It should be noted that the pneumatic tufting machines utilizing hollow needles as in U.S. Pat. No. 4,549,496 generally tuft laterally for between about one-half to four inches before backing fabric is advanced, or alternatively the backing fabric is advanced at a gradual rate as described in U.S. Pat. No. 5,267,520. Because the yarn being tufted is cut at least every time the color yarn tufted through a particular needle is changed, there is a minimum of unnecessary yarn placed as back stitches on the bottom of the tufted fabric. However, when attempts have been made to utilize a regular tufting machine configuration with a needle bar carrying a transverse row of needles in a similar fashion, the yarns are not selected for tufting and cut after tufting, but instead each yarn is tufted in every reciprocal cycle of the needle bar. Therefore, yarn carrying needles all penetrate the backing fabric on every cycle. The yarns are selected for display by a yarn pattern device feeding the yarn to be displayed and backrobbing the yarns that are not to be visible thereby withdrawing or burying the resulting yarn bights very close to the surface of the backing fabric. If several reciprocations are made as the needle bar moves laterally with respect to the backing fabric, then back stitch yarn for each of the colors of yarn is carried for each reciprocation and this results in considerable waste of yarn on the bottom of the resulting tufted fabric or greige that adds to the material and expense without contributing to the appearance or wear characteristics of the face of the fabric. Independently Controlled Needle (ICN) tufting machines typified by Kaju, U.S. Pat. No. 5,392,723 and related patents, operate similarly, except the selection of the needles for tufting determines the yarns that will be displayed.

It is also possible to create a similar color placement effect in a cut/loop pile fabric utilizing the level cut loop configuration of U.S. Pat. No. 7,222,576 tufted on a tufting machine having about a 1/10th gauge needle bar with a two-color repeating thread-up. The tufting machine is operated to tuft laterally twice while advancing the backing only about one half of the gauge distance on each reciprocation of the needle bar. A yarn color chosen for display may be either a cut or loop bight while the yarn color not to be shown on the face of the carpet is backrobbed, leaving only very low tufts of those yarns. With appropriate adjustments, three or more different yarns may be used in the thread-up with a corresponding increase in the number of lateral shifts and reduced rate of backing fabric advance. In this method of operation, there is considerable excess yarn carried on the bottom of the backing fabric.

Finally, to overcome these shortcomings, an alternative to produce similar fabrics with yarn placement has been achieved with a staggered needle configuration having front and rear rows of needles offset or staggered from one another. A staggered needle bar typically consists of two rows of needles extending transversely across the tufting machine. The rows of needles are generally spaced with a 0.25 inch offset in the longitudinal direction and are staggered so that the needles in the rear transverse row are longitudinally spaced between the needles in the front transverse row. Alternatively, two sliding needle bars each carrying a single transverse row of needles may be configured in a staggered alignment. Particularly when two sliding needle bars are used, the longitudinal offset between the rows of needles may be greater than 0.25 inches, and often about 0.50 inches.

In operation the needle bar is reciprocated so that the needles penetrate and insert loops of yarn in a backing material fed longitudinally beneath the needles. The loops of yarn are seized by loopers or hooks moving in timed relationship with the needles beneath the fabric. In most tufting machines with two rows of needles, there are front loopers which cooperate with the front needles and rear loopers which cooperate with the rear needles. In a loop pile machine, it may be possible to have two separate rows of loopers such as those illustrated in U.S. Pat. No. 4,841,886 where loopers in the front hook bar cooperate with the front needles and loopers in the rear hook bar cooperate with rear needles. Similar looper constructions have been used in tufting machines with separate independently shiftable front and rear needle bars, so that there are specifically designated front loopers to cooperate with front needles and specifically designated rear loopers to cooperate with rear needles. To achieve maximum density of needle penetrations, and to minimize the possibility of tufting front and rear needles through the same penetrations of the backing fabric, it is desirable to stagger the front loopers from the rear loopers by a half gauge unit.

The result of having loopers co-operable with only a given row of needles on a gauge tufting machine with two independently shiftable needle bars is that it is only possible to move a particular needle laterally by a multiple of the gauge of the needles on the relevant needle bar. Thus, for a fairly common 0.20 inch ($1/5^{th}$) gauge row of needles with corresponding loopers set at 0.20 inch gauge, the needles must be shifted in increments of 0.20 inches. This is so even though in a staggered needle bar with two longitudinally offset rows of 0.20 inch gauge needles the composite gauge of the staggered needle bar is 0.10 inch gauge. The necessity of shifting the rows of needles twice the gauge of the composite needle assembly results in patterns with less definition than could be obtained if it were possible to shift in increments of the composite gauge, and additional wasted backstitch yarn.

One effort to reduce the gauge of tufting has been to use smaller and more precise parts. Furthermore, in order to overcome the problem of double gauge shifting, U.S. Pat. No. 5,224,434 teaches a tufting machine with front loopers spaced equal to the composite gauge and rear loopers spaced equal to the composite gauge. Thus on a tufting machine with two rows of 0.20 inch gauge needles there would be a row of front loopers spaced at 0.10 inch gauge and a row of rear loopers spaced at 0.10 inch gauge. Although this allows the shifting of each row of needles in increments equal to the composite gauge, this solution was limited in by difficulties in creating cut and loop pile tufts from both the front needles and the rear needles.

Taking the arrangement of staggered needle bars shiftable at a composite gauge, and threading front needles with A and B yarns and rear needles with C and D yarns to form a repeat, a high volume of tufted fabric with selectively placed colored yarns can be manufactured with minimal wasted yarn used in the back stitching. This is because it is only necessary to shift each row of needles by a single lateral step in order to place all four A, B, C and D yarns in the desired location as described in U.S. Pat. No. 8,240,263.

In traditional carpet tufting applications, backing shifting has been relatively uncommon. In previous decades "jute-shifters" were employed as a technique to increase stitch density or break up straight lines of tufts. Such shifters were typically cam-driven in synchronization with the main stitch drive and were neither precise nor readily adjustable. Backing shifters have also been deployed on artificial turf tufting machines. Tufting machines optimized to produce artificial turf are characterized by large yarn carrying needles having a wide gauge spacing, often about on-half inch. The needle stroke is long as cut pile artificial turf may have two-inch-high tufts (even 2.65 inches in some applications), generally necessitating an even longer needle stroke. To position the cut pile bights of artificial turf from typical 3/8ths to 3/4ths gauge needle bars in suitable proximity to cover the backing fabric, the stitch rate will be run at perhaps 4 to 8 stitches per inch, and the backing fabric may be shifted from side to side by cams operating in linkage with the main tufting drive, most typically producing a wave or s-shape positioning of the needle relative to the fabric within the gauge space between needles.

Since the loops on conventional broadloom tufting machines are continuous as they are formed on the base below the backing, it is impractical to effectuate an efficient backing shift in the needle area because of the needle plate location with needle plate fingers between columns of pile tufts. Attempting to laterally shift the backing to any substantial degree, even a single gauge unit of the needle bar, causes the tufted face yarns to interfere with the needle plate fingers. Accordingly, in such a tufting machine, there have been attempts to use a pin roll positioned at a distance permitting tangential engagement of the backing layer, approximately two or three inches from the needle location, to move the backing a considerable distance to achieve a smaller movement of the fabric at the needle. Due to both the location of the pin rolls and the natural drag which is encountered because loops are positioned between needle plate fingers in proximity of the tufting zone it has not been practical to efficiently and precisely shift backing.

Co-owned U.S. Ser. No. 15/721,906 [PCT/US2017/054683], which is incorporated herein in its entirety, is directed to a backing shifter for use on broadloom tufting machine that is able to operate in a fashion that permits the shifting of the backing fabric relative to the needles and gauge parts without undo interference and thereby permits shifting not simply in gauge increments, but in a fashion that allows the creation of variable gauge and novel fabrics. This allows the tufting machine to create patterns similar to those created on a number of different tufting machines and it can be utilized to provide additional capacity for many desired product lines in the event of the need for extra capacity. Backing shifting also permits the creation of fabrics with different stitch densities to simulate the appearance of different gauge fabrics as described in co-owned U.S. Ser. No. 16/877,479 which is incorporated herein in its entirety.

When using a backing shifter, and particularly when adapting a historical pattern to be produced on a two needle bar configuration using precision backing shifting, the possibility exists that design parameters will be created that would ordinarily result in "sew through" and "sprouts." These conditions are caused by the rear row of needles over tufting stitches made by the front row of needles, and presents the opportunity for the previous tufts to push through the face of the carpet either presenting intermingled yarns from the front and back needles, or causing loops sewn by the front needles adjacent to the sew through to become detached from the backing and resulting in unusually high loops on the face in over-sewn locations. The same problem can be caused while producing fabrics with compressed stitch rates with backing shifting putting previously made tufts in danger of being over sewn by new tufts of a different rear row of needles, or even subsequent tufts from the same needle bar. In the patterns where all colors are tufted at each pixel location, and where the yarns that are not desired to show on the face of the fabric are backrobbed to float on the back side of the backing material, the sew through from yarns intended to be floating on the back are less common, as these are not actual previous tufts embedded in openings in the backing. Nonetheless, the intermittent tacking stitches are tufts subject to causing visual issues when over sewn. Issues with sew throughs are also exacerbated by certain yarn types and sizes that are more easily engaged by a needle. Therefore, a detection method of over-sewing possibilities is desired, as well as steps to mitigate any visual distortions to the patterns being tufted from yarn blending or excessive stitch heights.

A further complexity is added when tufting into many non-woven backing products that is common in the manufacture of commercial carpet tile. Non-woven fabrics are often less expensive or more dimensionally stable than comparable woven products, and for some carpet tile products non-woven materials may better resist curling in the installed floor covering. One of the downsides of a non-woven backing is that when the needle penetrates to make a tuft, the non-woven fabric does not have a physical structure that encourages the hole made by the needle to close up or shrink in size. By contrast, the structure of a woven backing encourages the needle hole to shrink in size although not fully close. In the woven backing example, the slight closing of the needle hole causes the yarn to be captured more securely by the backing providing a slight tightening on the stitch.

The result is that sew throughs resulting in blended tufts, and especially excessively high tufts are of particular concern when tufting into a non-woven primary backing. Therefore, a detection method of over-sewing possibilities, as well as steps to mitigate any visual distortions to the patterns being tufted from yarn blending or excessive stitch heights is of particular interest in tufted fabrics using a non-woven primary backing material.

Management of two needle bars in the tufting of multicolor patterns where all colors are tufted at each pixel location, and where yarns that are not desired to show on the face of the fabric are backrobbed to be tacked or to float on the back side of the backing material, present additional issues with positioning tufts of yarn. Traditional shifting patterns have been developed for needle bars assuming that only needle bars are shifting. When introducing the additional factor of backing shifting, the possibility exists that placements of different yarn colors will not be evenly distributed across the backing material so that the retained stitches desired to show on the face of the fabric will not be evenly spaced. In extreme cases, this may result in noticeable thinness in small areas of the face of the carpet or even the possibility of exposed backing fabric. The converse is also true and in other areas the stitch penetrations may be clustered so closely that even precautions such as marginal stepping will not suffice to prevent over-tufting or sprouts.

SUMMARY OF THE INVENTION

Accordingly, it is desired to combine the variable gauge tufting of U.S. Ser. No. 15/721,906 [PCT/US2017/054683] in traditional tufting practices with the yarn placement techniques of U.S. Pat. Nos. 8,141,505; 8,240,263; 9,556,548; 9,663,885; 10,167,585 and their related families of patents and pattern modification methods as described below, and especially using pattern scaling techniques disclosed in U.S. Ser. No. 16/877,479. This combination allows for the more efficient and varied production of patterned textiles from a single tufting machine.

In order to address the over-sewing issues, needle position detection algorithms are implemented and may be combined with a new method of marginal stepping of the needle bar in conjunction with shifting the backing fabric to minimize stitching too closely to previous tufts or penetrations that would otherwise result in blended yarn tufts or excessive height tufts. After determining that over-sewing concerns are present in a pattern, either experientially or by algorithmic analysis, two methods of mitigating the over-sewing concerns may be implemented. One method is to change the needle penetration pattern employed. This may be accomplished by changing the stepping pattern assigned to the backing shifter to provide different lateral stitch spacing, for instance, or by adjusting the increments of the backing feed on particular reciprocations of the needles so that there is a greater or lesser amount of longitudinal separation between penetrations. A second method is to employ a form of marginal shifting of the backing fabric. When the backing fabric is being shifted laterally, changing the penetration position of needles in the backing, and slightly moving the needles with the backing fabric engaged, provides the ability to distance new needle penetrations from previous penetrations. The use of different needles and yarn types may also be employed to avoid undesirable visual changes to the appearance of the tufted fabrics. Shift patterns may also be calculated to generate needle placements giving due consideration for both the needle bar shifting and lateral shifting of backing fabric in a single pattern.

BRIEF DESCRIPTION OF THE DRAWINGS

Particular features and advantages of the present invention will become apparent from the following description when considered in conjunction with the accompanying drawings in which.

DETAILED DESCRIPTION OF THE ILLUSTRATED EMBODIMENTS

Figure 1:
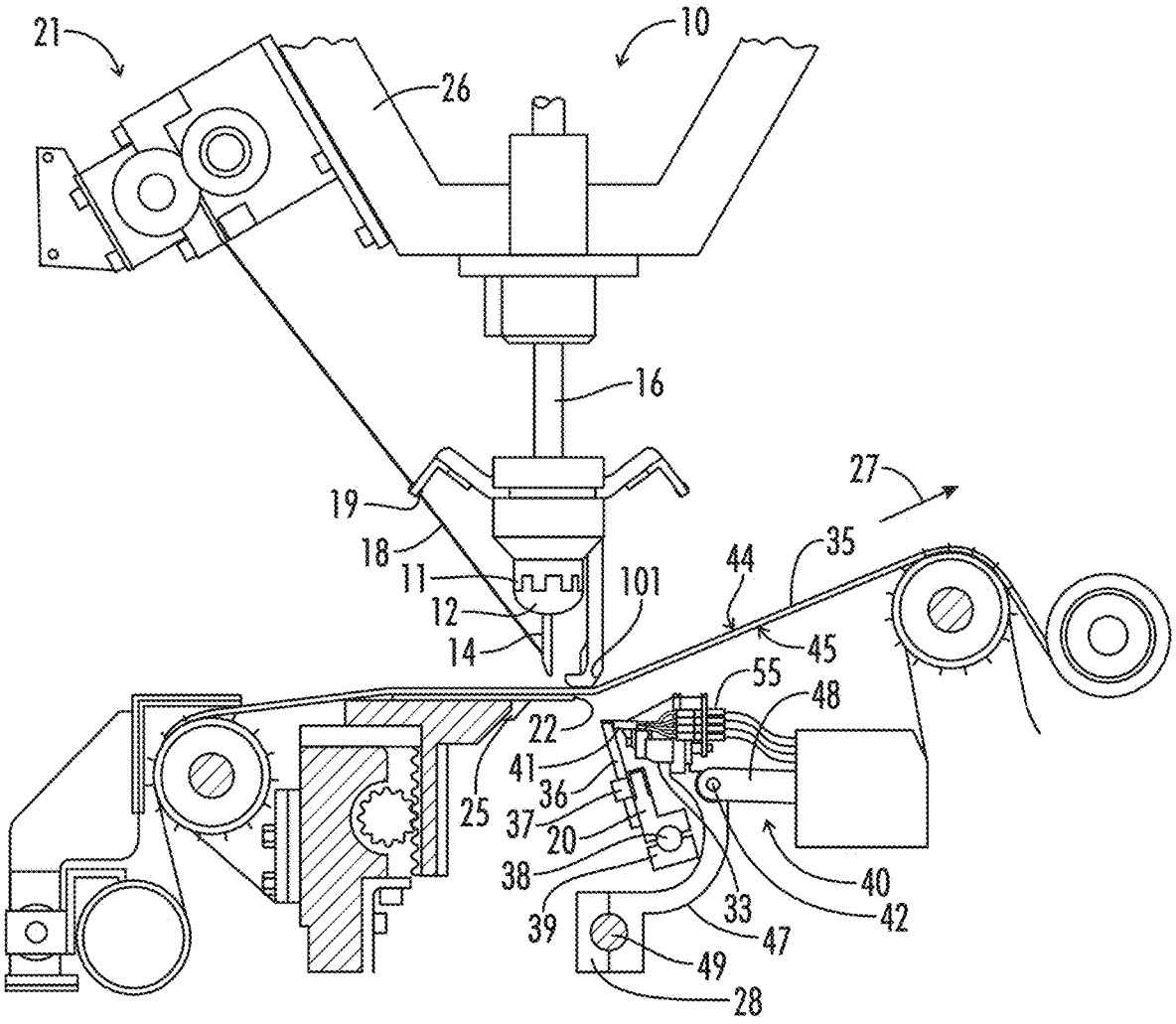
FIG. 1 (PRIOR ART)
FIG. 1 is a partial sectional end view of a prior art tufting machine with a single row of needles that can be operated to place yarns in the manufacture of fabrics with cut and loop face yarns.

Referring now to the drawings in more detail, FIG. 1 discloses a multiple needle tufting machine 10 including an elongated transverse needle bar carrier 11 supporting a needle bar 12. The needle bar 12 supports a row of transversely spaced needles 14. The needle bar carrier 11 is connected to a plurality of push rods 16 adapted to be vertically reciprocated by conventional needle drive mechanism, not shown, within the upper housing 26.

Yarns 18 are supplied to the corresponding needles 14 through corresponding apertures in the yarn guide plate 19 from a yarn supply, not shown, such as yarn feed rolls, beams, creels, or other known yarn supply means, preferably passing through pattern yarn feed control 21 though simpler yarn feed arrangements such as roll feeds may be employed. The yarn feed control 21 interfaces with a controller to feed yarns in accordance with pattern information and in synchronization with the needle drive, shifters, yarn seizing/cutting mechanisms and backing fabric feed.

The needle bar 12 may be fixedly mounted to the needle bar carrier 11 or may slide within the needle bar carrier 11 for transverse or lateral shifting movement by appropriate pattern control needle shifter mechanisms, in well-known manners. The backing fabric 35 is supported upon the needle plate 25 having rearward projecting transversely spaced front needle plate fingers 22, the fabric 35 being adopted for longitudinal movement from front-to-rear in a feeding direction, indicated by the arrow 27, through the tufting machine 10. The needle bar may have a single row of gauge spaced needles as shown, or may be a staggered needle bar with front and rear rows of needles, or may even be two separate needle bars, each with a row of needles and each being operable by needle shifter mechanisms.

The needle drive mechanism, not shown, is designed to actuate the push rods 16 to vertically reciprocate the needle bar 12 to cause the needles 14 to simultaneously penetrate the backing fabric 35 far enough to carry the respective yarns 18 through the back-stitch side 44 of backing fabric 35 to form loops on the face 45 thereof. After the loops are formed in this tufting zone, the needles 14 are vertically withdrawn to their elevated, retracted positions. When the needles are withdrawn, it is common to shift the needles and fabric relative to one another for patterning, and this portion of the cyclic reciprocation is referred to as a "shift window."

A yarn seizing apparatus 40 in accordance with this illustration includes a plurality of gated hooks 41, there preferably being at least one gated hook 41 for each needle 14. Each gated hook 41 is provided with a shank received in a corresponding slot in a hook bar 33 in a conventional manner. The gated hooks 41 may have the same transverse spacing or gauge as the needles 14 and are arranged so that the bill of a hook 41 is adapted to cross and engage with each corresponding needle 14 when the needle 14 is in its lower most position. Gated hooks 41 operate to seize the yarn 18 and form a loop therein when the sliding gate is closed by an associated actuator, such as pneumatic cylinder 55, and to shed the loop as the gated hooks 41 are rocked.

The elongated, transverse hook bar 33 and associated pneumatic assembly are mounted on the upper end portion of a C-shaped rocker arm 47. The lower end of the rocker arm 47 is fixed by a clamp bracket 28 to a transverse shaft 49. The upper portion of the rocker arm 47 is connected by a pivot pin 42 to a link bar 48, the opposite end of which is connected to be driven or reciprocally rotated by conventional looper drive. Adapted to cooperate with each hook 41 is a knife 36 supported in a knife holder 37 fixed to knife block 20. The knife blocks 20 are fixed by brackets 39 to the knife shaft 38 adapted to be reciprocally rotated in timed relationship with the driven rocker arm 47 in a conventional manner. Each knife 36 is adapted to cut loops formed by each needle 14 upon the bill of the hook 41 from the yarn 18 when gates are retracted and yarn loops are received on the hooks 41. A preferred gated hook assembly is disclosed in U.S. Pat. No. 7,222,576 which is incorporated herein by reference.

It can be seen in FIG. 1 that the tufted greige 35 with backstitch side 44 and face side 45 is lifted away from the tufting zone after passing presser foot 101. When employing a backing shifter, it is helpful to move the face side 45 away from the hook apparatus of a cut pile or cut loop configuration as the lateral shifting of the backing could cause interference between the tufted yarns on the face 45 and the hooks 41. The yarn seizing gauge parts may also be loopers that are disengaged from the loops of yarn after each stitch rather than hooks that often need to carry a seized loop of yarn for one or more additional stitches to affect a cut pile by operation of the associated knife 36. The gauge parts may even be a combination of hooks and loopers.

Figure 2A:
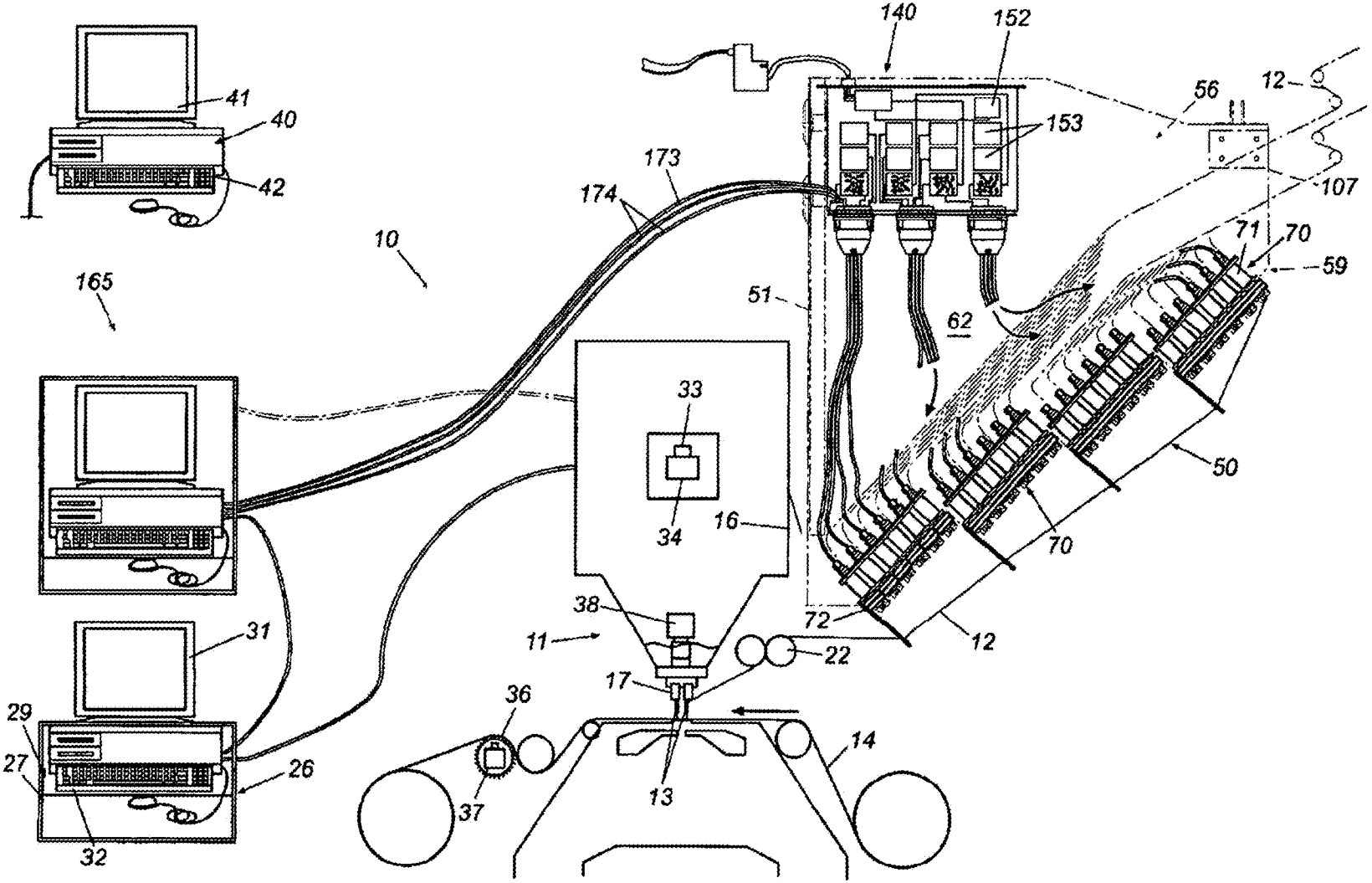
FIG. 2A (PRIOR ART)
FIG. 2A is a prior art schematic illustration of the operative components of a tufting machine equipped with a pattern control yarn feed.
Figure 2B:
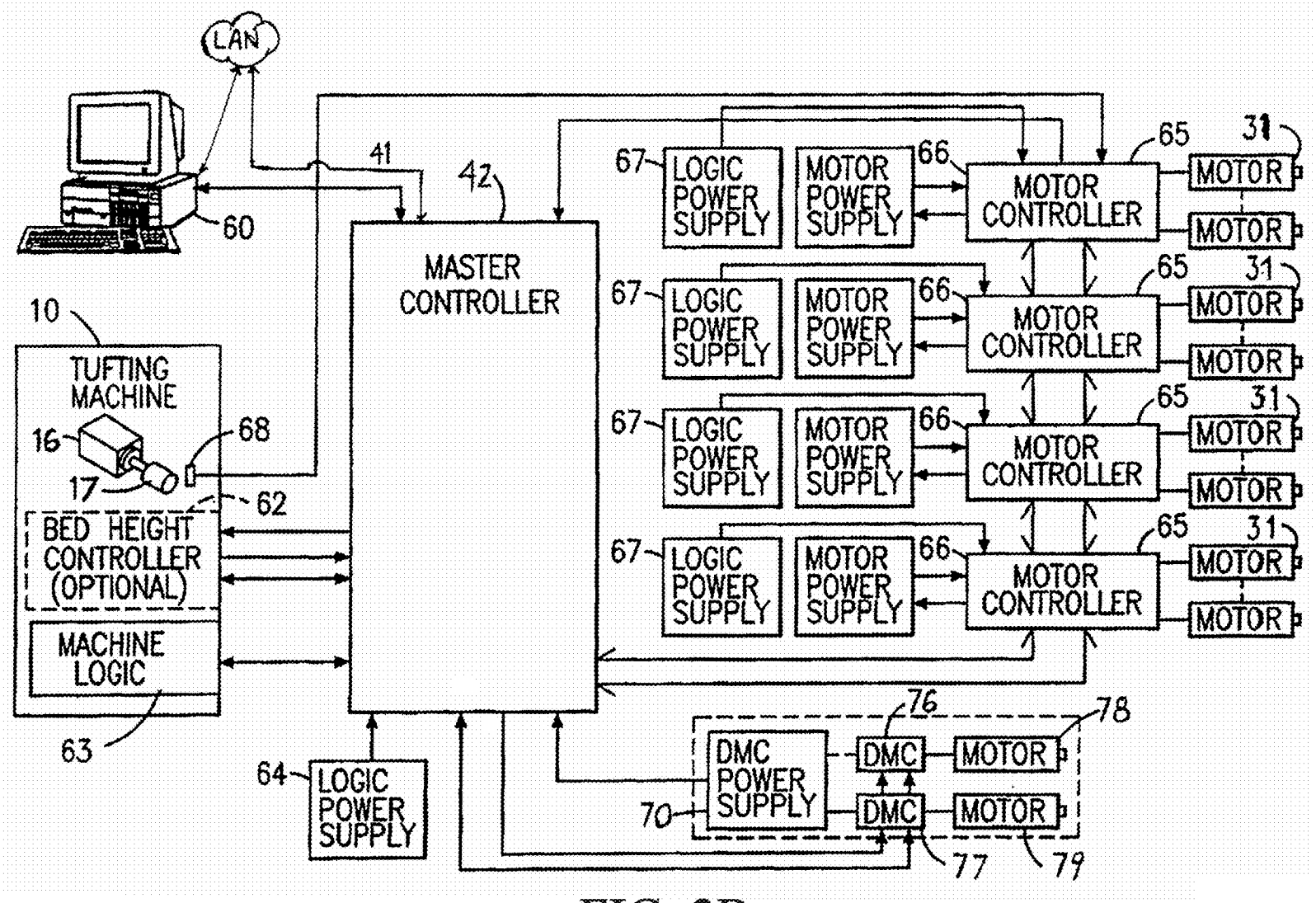
FIG. 2B (PRIOR ART)
FIG. 2B is a prior art schematic illustration of the operative components of an alternative tufting machine embodiment equipped with a pattern control yarn feed.
Figure 4A:
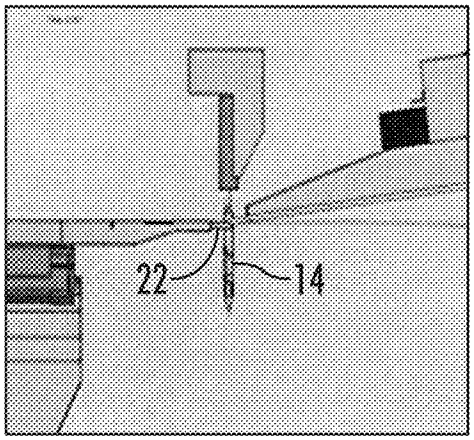
FIGS. 4A-4F are sequential side plan views of a tufting cycle corresponding to FIGS. 3A-3F.
Figure 3A:
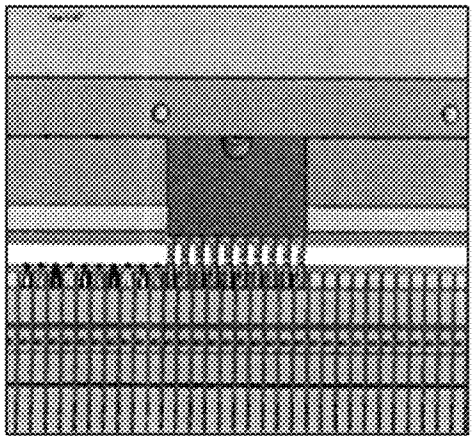
FIGS. 3A-3F are sequential front plan view of a tufting cycle of shifting backing feed and reciprocating needle plate through a tufting cycle.

FIGS. 2A and 2B illustrate the control systems for tufting machines capable of single or double end yarn control on a stitch by stitch basis, and capable of selective yarn placement. As indicated in FIG. 2A, the tufting machine 11 includes a tufting machine controller or control unit 26, such as disclosed in U.S. Pat. No. 5,979,344 in the case of machines manufactured by Card Monroe Corp., that monitors and controls the various operative elements of the tufting machine, such as the reciprocation of the needle bars, backing feed, shifting of the needle bars, bedplate position, etc. Such a machine controller 26 typically includes a cabinet or work station 27 housing a control computer or processor 28, and a user interface 29 that can include a monitor 31 and an input device 32, such as a keyboard, mouse, keypad, drawing tablet, or similar input device or system. The tufting machine controller 26 controls and monitors feedback from various operative or drive elements of the tufting machine such as receiving feedback from a main shaft encoder 33 for controlling a main shaft drive motor 34 so as to control the reciprocation of the needles, and monitoring feedback from a backing feed encoder 36 for use in controlling the drive motor 37 for the backing feed rolls to control the stitch rate or feed rate for the backing material. A needle sensor or proximity switch (not shown) also can be mounted to the frame in a position to provide further position feedback regarding the needles. In addition, for shiftable needle bar tufting machines, the controller 26 further will monitor and control the operation of needle bar shifter mechanism(s) 38 for shifting the needle bars 17 according to programmed pattern instructions, and for cut/loop tufting machines may control gauge part actuators including controls for pneumatic actuators 55.

The tufting machine controller 26 receives and stores such programmed pattern instructions or information for a series of different carpet patterns. These pattern instructions can be stored as a data file in memory at the tufting machine controller itself for recall by an operator, or can be downloaded or otherwise input into the tufting machine controller by the means of a digital recording medium such as a USB flash drive, direct input by an operator at the tufting machine controller, or from a network server via network connection. In addition, the tufting machine controller can receive inputs directly from or through a network connection from a design center 40. The design center 40 can include a separate or stand-alone design center or work station computer 41 with monitor 42 and user input 43, such as a keyboard, drawing tablet, mouse, etc., through which an operator can design and create various tufted carpet patterns. This design center also can be located with or at the tufting machine or can be remote from the tufting machine.

An operator can create a pattern data file or graphic representations of the desired carpet pattern at the design center computer 41, which will calculate the various parameters required for tufting such a carpet pattern at the tufting machine, including calculating yarn feed rates, pile heights, backing feed or stitch rate, and other required parameters for tufting the pattern. These pattern data files typically then will be downloaded or transferred to the machine controller, to a thumb drive or similar recording medium, or can be stored in memory either at the design center or on a network server for later transfer and/or downloading to the tufting machine controller. Further, for design center located work stations and/or where the machine controller has design center functionality or components programmed therein, it is preferable, although not necessarily required, that the design center 40 and/or machine controller 26 be programmed with and use common Internet protocols (i.e., web browser, FTP, etc.) and have a modem, Internet, or network connection to enable remote access and trouble shooting.

The yarn feed system 10 comprises a yarn feed unit or attachment 50 that can be constructed as a substantially standardized, self-contained unit or attachment capable of being releasably mounted to and removable from the tufting machine frame 16 as a one-piece unit or attachment. This enables the manufacture of substantially standardized yarn-feed units capable of controlling the feeding of individual yarns to a predetermined number or set of needles of the tufting machine.

The yarn feed unit 50 further includes a series of yarn feed devices 70 that are received and removably mounted within the housing 56 of the yarn feed unit. The yarn feed devices engage and feed individual yarns to associated needles of the tufting machine for individual or single end yarn feed control, although in some configurations, the yarn feed devices also can be used to feed multiple yarns to selected sets or groups of needles. For example, in a machine with 2,000 needles, each yarn feed unit could control two or more yarns such that 1,000 or fewer yarn feed units can be used to feed the yarns to the needles. Each of the yarn feed devices 70 includes a drive motor 71 that is received or releasably mounted within a motor mounting plate 72, mounted to the frame 51 of the yarn feed unit 50 along the front face or side 59 of the housing 56. The motor mounting plates 72 include a series of openings or apertures 73 in which a drive motor 71 is received for mounting.

In some cases, yarns may be directed from the yarn feed device 70 to needles 14 in a direct fashion. In other cases, a series of yarn feed tubes are extended along the open interior area 62 of the yarn feed unit housing 56. Each of the yarn feed tubes 105 is formed from a metal such as aluminum or may be formed from various other types of metals or synthetic materials having reduced frictional coefficients so as to reduce the drag exerted on the yarns. The yarn feed tubes 105 extend from an upper or first end 106 adjacent a yarn guide plate 107 mounted to the front face or surface of the housing 56, and extend at varying lengths, each terminating at a lower or terminal end 108 adjacent a drive motor 71.

The system controller communicates with each of the yarn feed controllers via the network cables 173,174 and 176,177, with feedback reports being provided from the yarn feed controllers to the system controller over the first, feedback or real-time network (via network cable 173) so as to provide a substantially constant stream of information/feedback regarding the drive motors 71. Pattern control instructions or motor gearing/ratio change information for causing the motor controllers 152 to increase or decrease the speed of the drive motors 71 and thus change the rate of feed of the yarns as needed to produce the desired pattern step(s), are sent to the control processors 152 of the yarn feed controllers 140 over the pattern control information network cables 174.

The system controller further can be accessed or connected to the design center computer 40 through such communications package or system, either remotely or through a LAN/WAN connection to enable patterns or designs saved at the design center itself to be downloaded or transferred to the system controller for operation of the yarn feed unit. The system design center computer further has, in addition to drawing or pattern design functions or capabilities, operational controls that allow it to enable or disable the yarn feed motors, change yarn feed parameters, check and clear error conditions, and guide the yarn feed motors. As discussed above, such a design center component, including the ability to draw or program/create patterns also can be provided at the tufting machine controller 26, which can then communicate the programmed pattern instructions to the system controller, or further can be programmed or installed on the system controller itself. Thus, the system controller can be provided with design center capability so as to enable an operator to draw and create desired carpet patterns directly at the system controller.

In operation of the yarn feed control system 10, in an initial step, the system controller 165 of the yarn feed controller system 10, and the tufting machine controller 26 are powered on, after which the tufting machine controller proceeds to establish existing machine parameters such as reciprocation of the needles, backing feed, bed rail height, etc. The operator then selects a carpet pattern to be run on the tufting machine. This carpet pattern can be selected from memory, stored at a network server from which a carpet pattern data file will be downloaded to internal memory of the tufting machine or system controller, or stored directly in memory at the tufting machine controller or system controller.

Alternatively, the pattern or pattern data file can be created at a design center. The design center calculates yarn feed rates and/or ratios, and pile heights for each pattern step, and will create a pattern data file, which is then saved to memory. After the desired carpet pattern has been selected, the pattern information typically is then loaded into the system controller 165 of the yarn feed control system 10. The operator then starts the operation of the yarn feed control system, whereupon the yarn feed devices 70 pull and feed yarns from a creel (not shown) at varying rates according to the programmed pattern information, which yarns are fed to puller rolls 22, that in turn, feed the yarns directly to the individual needles 13 of the tufting machine 11. The system controller sends pattern control instructions or signals regarding yarn feed rates or motor gearing/feed that are rationed to the rotation of the main drive shaft of the tufting machine, individual yarns to the yarn feed controllers 140 via control information network cables 174. Such pattern control instructions or signals/information are received by the control processors 152, which route specific pattern control instructions to the motor controllers or drives 153, which accordingly cause their drive motors 71 to increase or decrease the feeding of the yarns 12, as indicated at 221, as required for pattern step.

As further indicated at 223, the motor controllers monitor each of the drive motors under their control and provide substantially real-time feedback information 224 to the system controller, which is further receiving control and/or position information regarding the operation of the main shaft and the backing feed from the tufting machine controller that is monitoring the main shaft and backing feed encoders, needle bar shift mechanism(s) and other operative elements of the tufting machine. This feedback information is used by the system controller to increase or decrease the feed rates for individual yarns, as needed for each upcoming pattern step for the formation of the desired or programmed carpet pattern. After the pattern has been completed, the operation of the yarn feed control system will be halted or powered off, as indicated in 225.

Turning now to FIG. 2B, a general electrical diagram is shown of a computerized tufting machine with main drive motor 19 and drive shaft 17. A personal computer 60 is provided as a user interface, and this computer 60 may also be used to create, modify, display and install patterns in the tufting machine 10 by communication with the tufting machine master controller 42. Due to the very complex patterns that can be tufted when individually controlling each end of yarn, many patterns will comprise large data files that are advantageously loaded to the master controller by a network connection 61; and preferably a high bandwidth network connection.

Master controller 42 preferably interfaces with machine logic 63, so that various operational interlocks will be activated if, for instance, the controller 42 is signaled that the tufting machine 10 is turned off, or if the "jog" button is depressed to incrementally move the needle bar, or a housing panel is open, or the like. Master controller 42 may also interface with a bed height controller 62 on the tufting machine to automatically effect changes in the bed height when patterns are changed. Master controller 42 also receives information from encoder 68 relative to the position of the main drive shaft 17 and preferably sends pattern commands to and receives status information from controllers 76, 77 for backing tension motor 78 and backing feed motor 79 respectively. Said motors 78, 79 are powered by power supply 70. Finally, master controller 42, for the purposes, sends ratiometric pattern information to the servo motor controller boards 65. The master controller 42 will signal particular servo motor controller board 65 that it needs to spin its particular servo motors 31 at given revolutions for the next revolution of the main drive shaft 17 in order to control the pattern design. The servo motors 31 in turn provide positional control information to their servo motor controller board 65 thus allowing two-way processing of positional information. Power supplies 67, 66 are associated with each servo motor controller board 65 and motor 31.

Master controller 42 also receives information relative to the position of the main drive shaft 17. Servo motor controller boards 65 process the ratiometric information and main drive shaft positional information from master controller 42 to direct servo motors 31 to rotate yarn feed rolls 28 the distance required to feed the appropriate yarn amount for each stitch. Though not specifically illustrated in FIG. 2B, the main drive shaft positional information from the master controller also is processed by controllers for operating one or two needle bar shifting mechanisms, to move the needles during appropriate shift windows to the location required in the pattern instructions.

When adapted for use with a reciprocating needleplate as in U.S. Ser. No. 15/721,906 [PCT/US2017/054683], the master controller also should provide signals to control the additional axis for the rotation of the cam in a fashion that is essentially rotating a cam profile through a single revolution for each tufting cycle. The cam profile and speed of rotation determines the longitudinal movement imparted to the needleplate and the speed of movement.

Figure 5A:
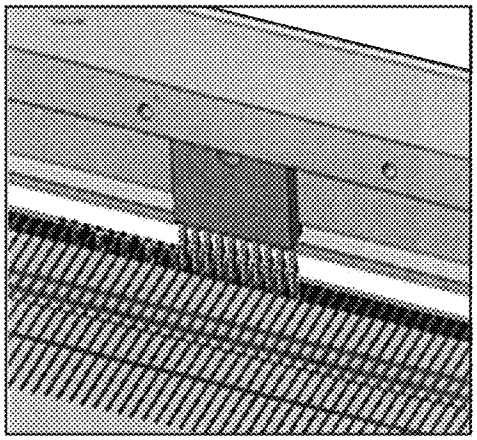
FIGS. 5A-5F are sequential front perspective views of a tufting cycle corresponding to FIGS. 3A-3F.
Figure 5B:
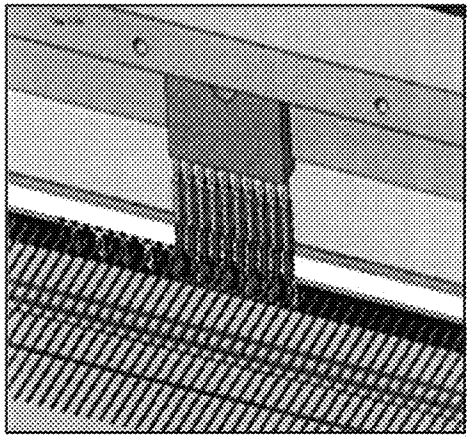
Figure 4B:
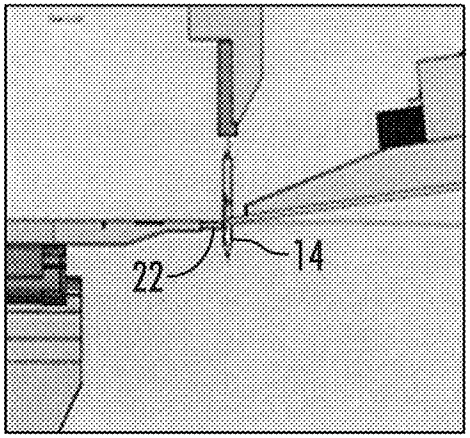
Figure 3B:
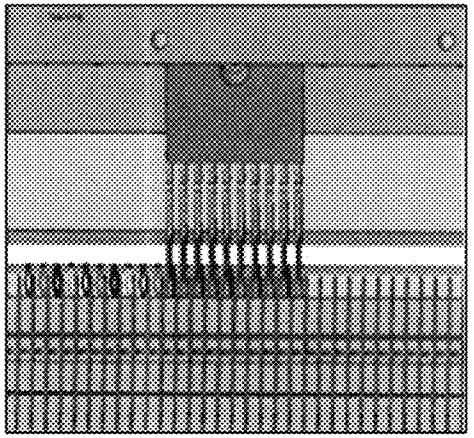
Figure 5C:
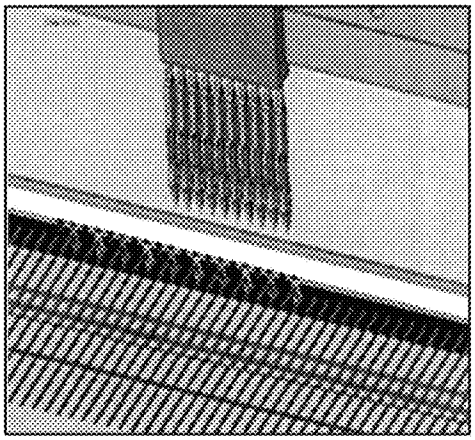
Figure 4C:
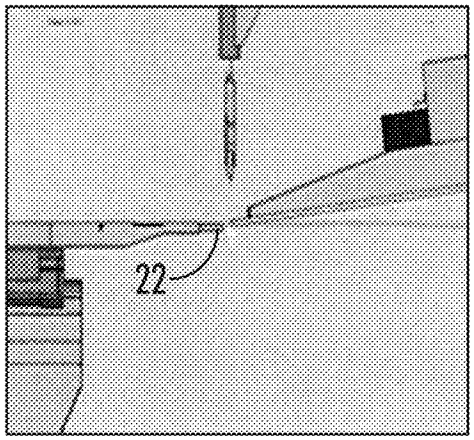
Figure 3C:
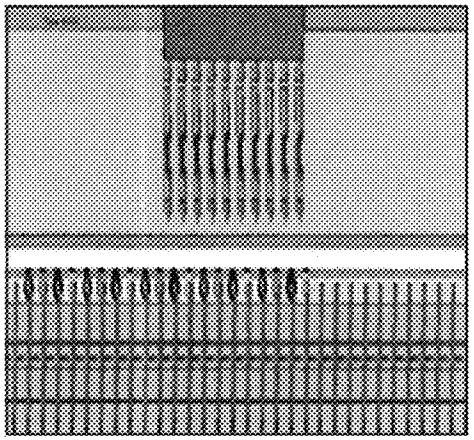
Figure 5D:
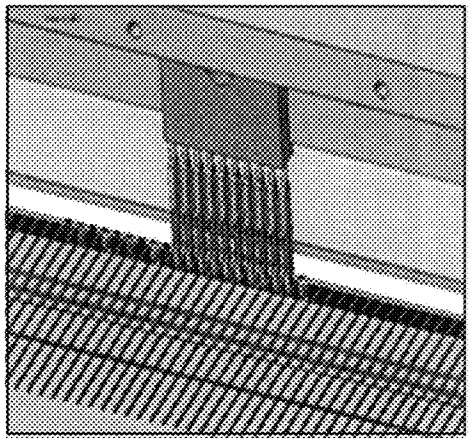
Figure 4D:
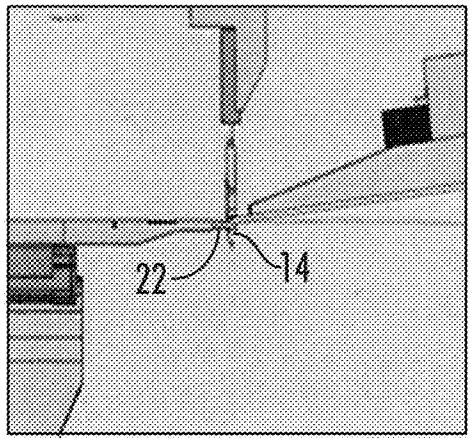
Figure 3D:
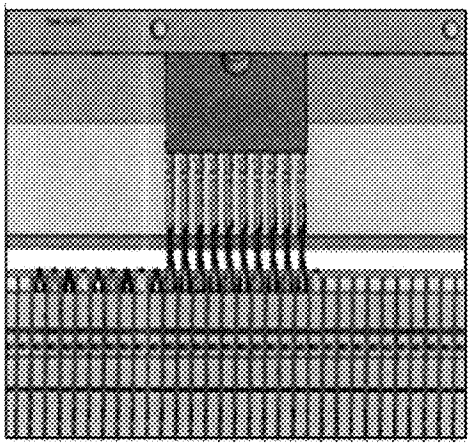
Figure 3E:
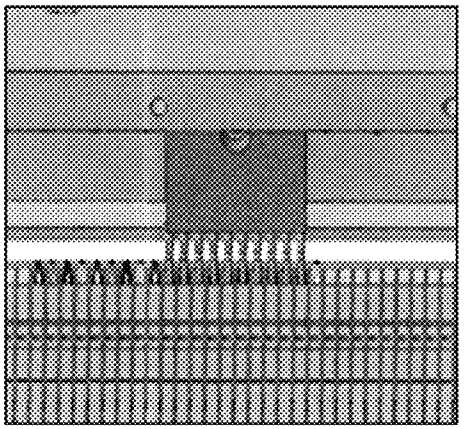
Figure 4E:
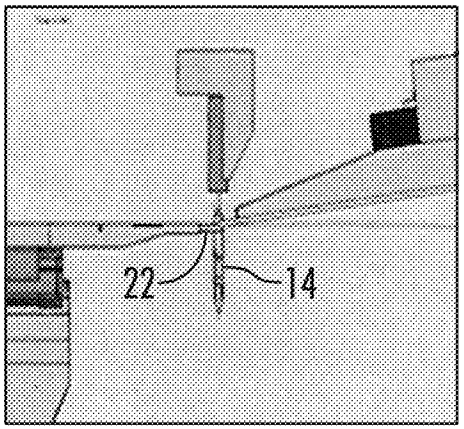
Figure 5E:
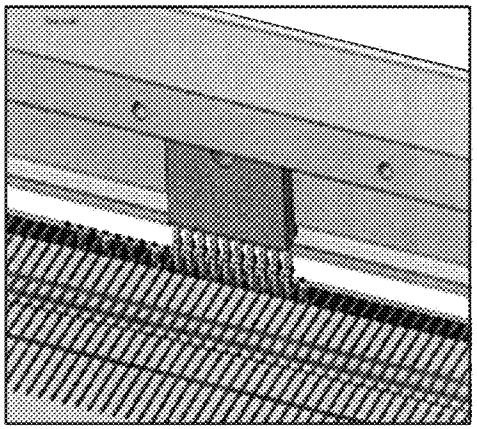
Figure 3F:
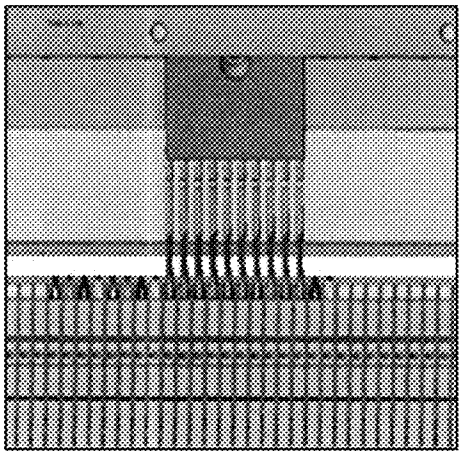
Figure 4F:
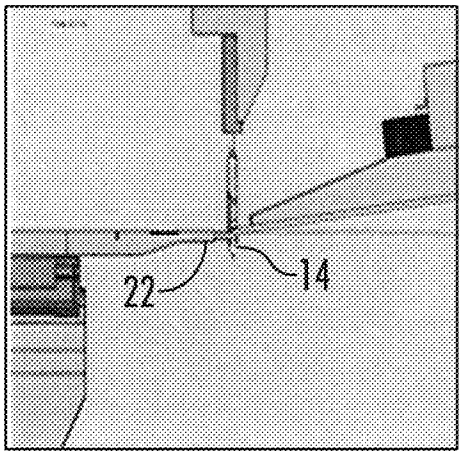
Figure 5F:
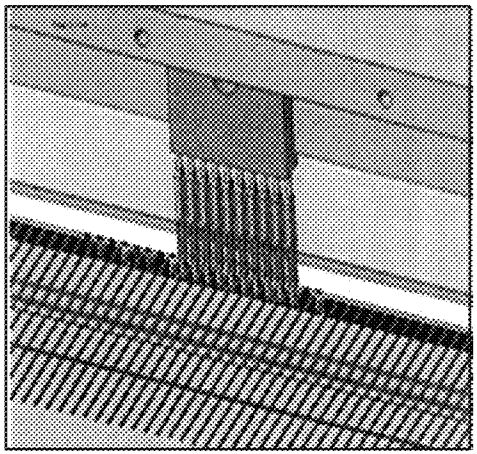

FIGS. 3A-F and corresponding views in FIGS. 4A-F and 5A-F illustrate the tufting zone movement of the needle plate fingers 22 in the shiftable backing fabric design that facilitates adapting a single tufting machine to sew at different gauge densities. It can be observed in FIGS. 3A, 4A, 5A that the needle plate finger 22 extends essentially to the presser foot and through much of the diameter of the needle 14 passing behind the needle plate finger. As the needle 14 moves upward retracting from the backing fabric, the needle plate finger is similarly retracted toward the front of the tufting machine as shown in FIGS. 3B, 4B, 5B. In FIGS. 3C, 4C, 5C, the needle is free of the backing fabric and space exists between the needle plate fingers 22 and presser foot. As the needles 14 again move downward in FIGS. 3D, 4D, 5D, the needle plate fingers 22 move forward to support the backing fabric and remain in that position through the downward stroke as shown in FIGS. 3E, 4E, 5E but again begin to retract as needles 14 are removed from the backing fabric in FIGS. 3F, 4F, 5F.

Figure 6A:
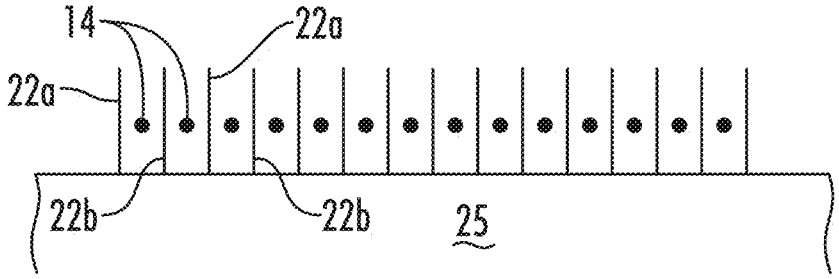
FIG. 6A is a top plan illustration of the needles and needle plate fingers of a reciprocating needle plate for a single row of needles.
Figure 6B:
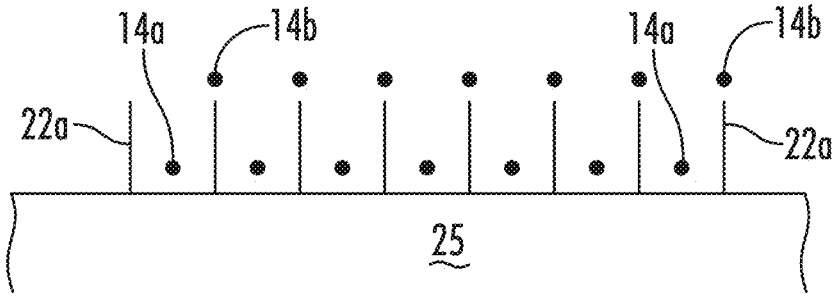
FIG. 6B is a top plan illustration of the location of the needles and needle plate fingers of a reciprocating needle plate for two rows of needles.

FIGS. 6A and 6B show the relative locations of needle plate fingers 22 and needles 14 in exemplary arrangements of one row of needles (FIG. 6A) and two rows of needles (FIG. 6B). When using a single row of needles 14 the needles are directly between needle plate fingers 22*a*, 22*b* at the time of penetrating the backing fabric. However, when two rows of needles are used, the front row of needles 14*a* are directly between needle plate fingers 22*a* at the time of penetrating the backing fabric. However the rear row of needles 14*b* are located just beyond the ends of needle plate fingers 22*a*. Thus, the backing fabric near front needles 14*a* is supported by needle plate fingers 22*a* on either side, but the fabric near rear needles 14*b* is supported only by the end of the adjacent needle plate finger 22*a*. To improve the fabric support, in either case, it is sometimes helpful to place a riser beneath the face of the tufted greige to lift the tufted fabric upward as soon after the presser bar as practicable.

The backing assembly can be precisely shifted for substantial distances, typically on the order of 1 to 2.5 inches in each direction from center. This provides tufting machine with great versatility and allows a quarter gauge tufting machine to simulate a $\frac{1}{8}^{th}$ gauge tufting machine and provides numerous patterning advantages. Furthermore, a $\frac{1}{8}^{th}$ gauge tufting machine can very nearly imitate a $\frac{1}{10}^{th}$ gauge tufting machine, although not all stitches will appear in perfectly aligned rows. By way of example, a $\frac{1}{8}^{th}$ gauge machine will most commonly tuft at a stitch rate of about 8 stitches per inch, thereby placing 64 stitches in a square inch of backing. A $\frac{1}{10}^{th}$ gauge machine will most commonly tuft at about 10 stitches per inch with a resulting 100 stitches being placed in a square inch of backing. However, by increasing the stitch rate of a $\frac{1}{8}^{th}$ gauge tufting machine equipped with backing shifter and reciprocating needle plate to 12.5 stitches per inch, a stitch density of 100 stitches per square inch is effected. In cases where the stitch rate is being increased by a multiple of the gauge of the machine equipped with a backing shifter and reciprocating needle plate, there may be a perfect pattern alignment. In other cases, the stitches may not align in exact longitudinal rows.

The failure to align in exact longitudinal rows may be perceived as an advantage in some tufting applications. For instance, solid color shifting is used when manufacturing solid single-color carpets to break up any streaks or irregularities in the yarns that might otherwise be noticeable. Residential solid color carpets are sometimes sewn on $\frac{5}{32}$nds or $\frac{3}{16}^{th}$ inch gauge staggered needle bars with two rows of needles. These needle bars require shifts of 0.375 or 0.3125 inches for the streak break-up shifting. With a backing shifter and reciprocating needle plate equipped tufting machine, shifts of as little as 0.10 inches, and for some yarns and stitch densities even as little as 0.05 inch lateral shifts, may be employed. The smaller shifts permit greater machine speed and require less lateral yarn on the backstitch that is lost to effective use.

Figure 7:
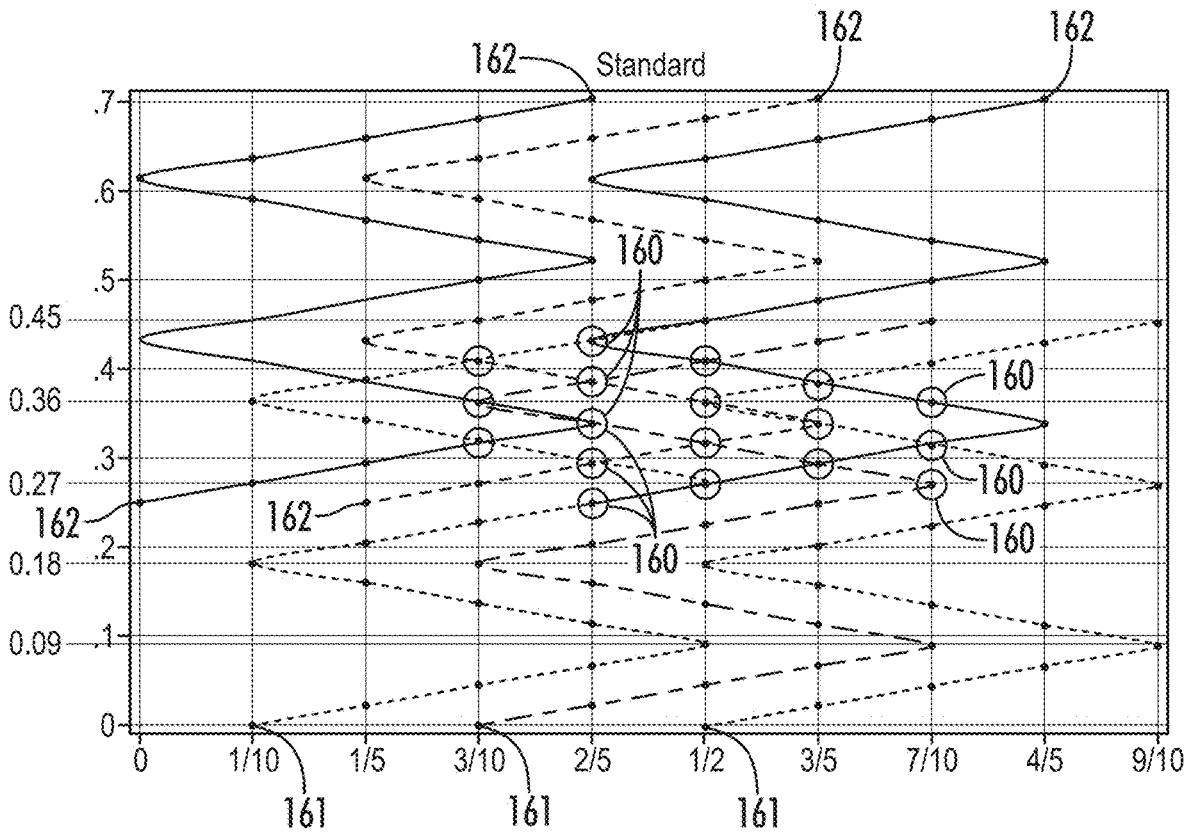
FIG. 7 is a graphic illustration of penetration points made by sequential tufting of front and rear rows of needles on a backing fabric showing locations where over-sewing conflicts may arise.

When the machine gauge and sew gauge align, and in some other instances, particularly when using front and rear rows of needles, the possibility of adverse visual effects from over-sewing occurs. For instance, FIG. 7 illustrates needle penetration patterns from front and rear needle bars that are in an ABCD thread-up with the needle bars shifting in unison relative to the backing fabric four sequential gauge units to the right and then four sequential gauge units to the left. The two rows of needles are offset by 0.25 inches in the particular machine configuration and the illustration shows that after about 12 stitches, the stitch penetrations from the rear needle bar 161 sew almost directly over penetrations from the front needle bar 162, creating the possibility of visual defects from over-sewing marked as intersections 160. This illustrated pattern in FIG. 7 shows an extreme example of over-sewing. According, it is generally desirable to attempt to modify the patterns such that the machine gauge and sew gauge are distinct or so that a stitch rate is selected that does not have a multiple proximate the longitudinal needle bar offset when front and rear needles are aligned after the number of stitches required to tuft the offset distance.

When pattern alterations are not readily feasible, however, a marginal step technique may be employed. Marginal stepping involves using the needle bar to shift penetrations in the backing fabric slightly off-gauge by a lateral offset (typically about 0.001 to 0.030 of an inch). The marginal step row of needles will penetrate the backing slightly off-gauge (meaning not precisely in alignment with the associated gauge parts for seizing loops of yarn), and then shift to an on-gauge position while moving the adjacent backing with the needles. In the past, marginal stepping has been used under the name "positive stitch placement" with single needle bar configurations, or with two rows of needles moving in unison, to break up yarn streaks on a tufted product, or to slightly stagger tufts of face yarn to help cover the face more effectively. When used in connection with two needle bars and backing shifting as described herein, the off-gauge penetrations help to place potentially over-sewn stitches in locations that reduce the likelihood that a needle will strike or push out a previously-tufted stitch.

Figure 8:
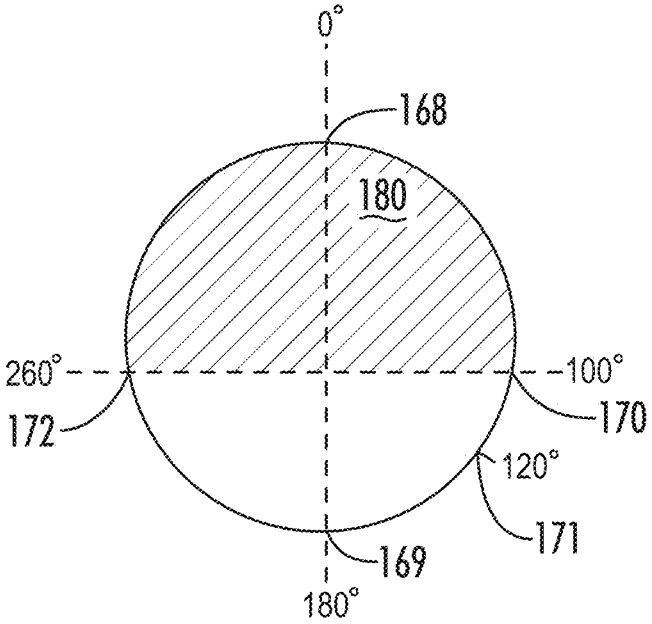
FIG. 8 is a circular or polar representation of a needle reciprocation cycle annotated to show the shift window and general gauge part and backing shift timing.

FIG. 8 is a circular representation of stitch cycle with 0 degrees as being marked top dead center position when the needle is at the highest point removed from the backing fabric, the arc between 100 degrees and 260 degrees being the part of the stitch cycle when the needle has penetrated the backing fabric, and 180 degrees being marked as bottom dead center when the loopers are engaged with loops of yarn on the needle to seize yarn loops and form the face of the greige.

The upper portion of the arc between 260 degrees and 100 degrees is the shift window when the needles and backing fabric are not engaged and can be moved relative to one another. In the case of marginal stepping, using a backing shifter, there are two additional elements of movement. For instance, in a pattern where the backing fabric is simply moving a gauge unit to the right for four sequential steps, during the shift window the backing fabric makes this movement. Also, during the shift window, the needles on one of the rows of needles are moved off-gauge by a small amount, typically 0.010 to 0.020 inches. At the conclusion of the shift window 100 degrees, the needles penetrate the backing fabric and move to the left by the previously moved off-gauge offset amount so that the needles are again on-gauge. Typically this realignment movement is completed by about 120 degrees or 130 degrees in the needle reciprocation cycle. The needles continue as normal to bottom dead center where gauge parts seize yarns from the needles and form loops on the face of the greige. The result is that the penetrations from the marginally-offset needles occur approximately 0.010 to 0.020 inches further to the right of the standard penetration positions, thereby avoiding direct collision or over-sewing of earlier stitch penetrations.

The amount of marginal offset is tightly constrained because it must occur within the space of a single gauge increment or the needles run the risk of crossing a needle plate finger or yarn seizing gauge part with the problematical result of a collision or impeding the gauge part movement after penetrating the backing fabric. Given the thickness of the gauge parts, and the needle gauge spacing on needle bars typically being no more than 0.25 inches, and the thickness of yarns and needles themselves, the resulting confined space means that marginal offset distances greater than about 0.030 inches are rarely feasible. However, these distances of only 0.01 to 0.03 inches when implemented on one of two rows of needles that would otherwise oversew, is frequently sufficient to avoid visual distortions from either extended-height tufts or yarn blending from stitching by two needles in the same penetration.

Figure 9:
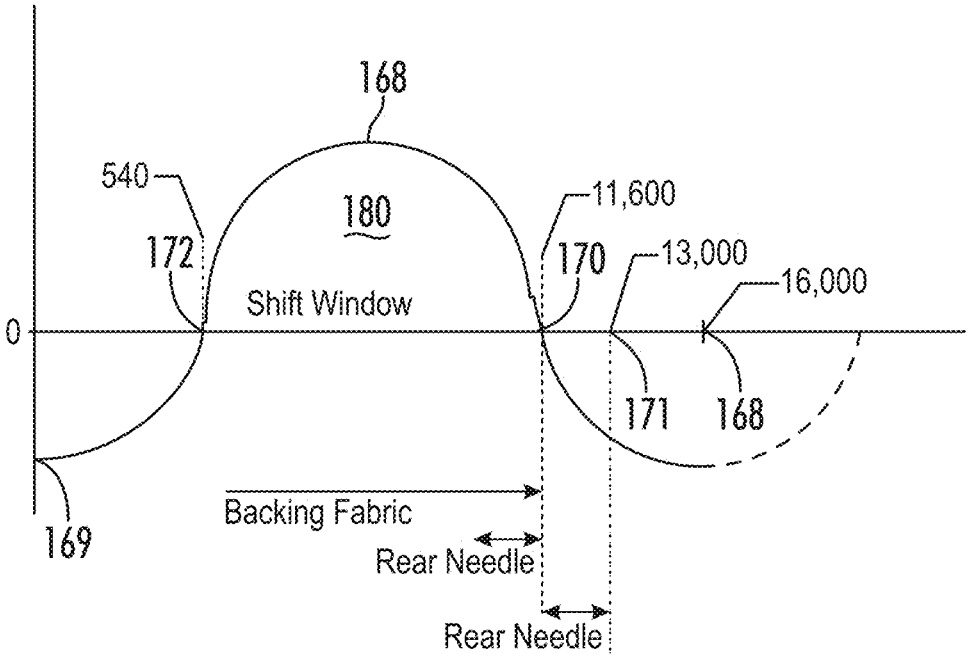
FIG. 9 is a Cartesian representation of the stitch cycle annotated as in FIG. 8 marked for sensor count timing.

FIG. 9 shows the same needle reciprocation cycle as FIG. 8, but in a Cartesian arrangement that would typically be associated with the sensor position counts provided to the controllers for the tufting machine. So, for instance, the illustrated cycle would commonly start at count 0 and proceed to count 16,000. It being understood that the number of sensor counts is not particularly critical and is likely to increase over time as motion control technologies improve and become faster and less-expensive. When the stitch cycle hits the shift window, typically at around count 5,500 of 16,000, the backing fabric, if stepping to the right, shifts a gauge position to the right, and the rear row of needles is shifted by the marginal step amount to the right. At the conclusion of the shift window, the needles from the front and rear needle bars penetrate the backing fabric. Then, over the next approximately 1,500 counts, the marginally-offset rear needles are moved to the left to be in their on-gauge position so that they will properly cooperate with the yarn seizing gauge parts.

Figure 10:
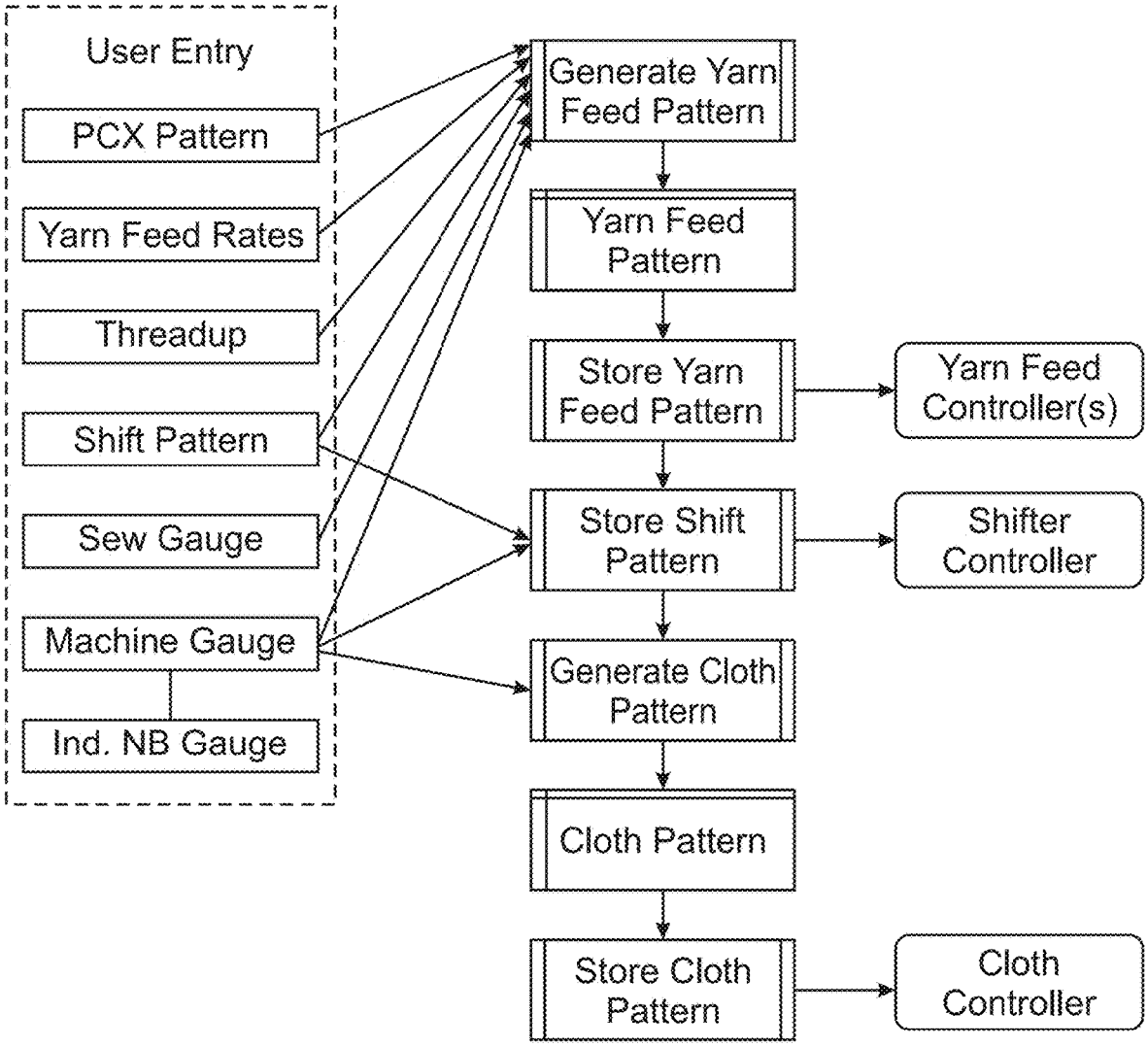
FIG. 10 is a schematic diagram illustrating the data inputs and processing to create pattern instructions for a tufting machine operable to produce variable gauge fabrics with yarn placement functionality.

FIG. 10 provides an overview of how the data input from the pattern file is combined with the operator inputs to create pattern information files that are transmitted from the operator interface computer to the controllers for the appropriate axes of movement that cause the shifting, feeding, and reciprocation of parts that results in tufted fabrics.

Figure 11:
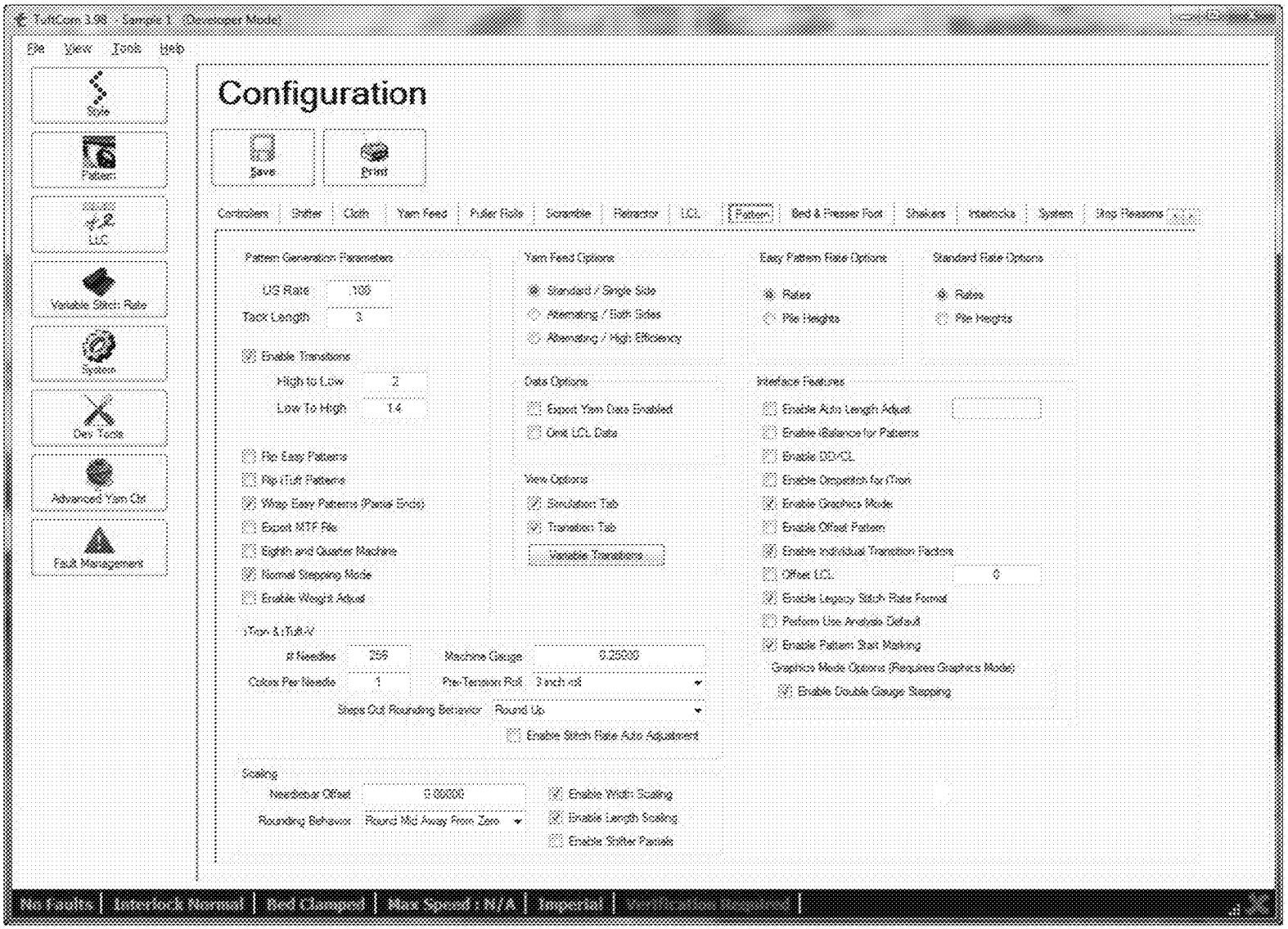
FIG. 11 is an exemplary operator Configuration screen showing input of information utilized in computing the calculation of pattern details.

FIG. 11 is an exemplary operator configuration page for pattern generation. Notably, because of the rescaling algorithm, many approximations must be made to a pattern. To achieve the most aesthetic pattern, the ability to select from a variety of rounding behaviors for these approximations is desirable. The typical alternatives are round mid-to-even, round up, round down, and round mid-away-from-zero.

Figure 12:
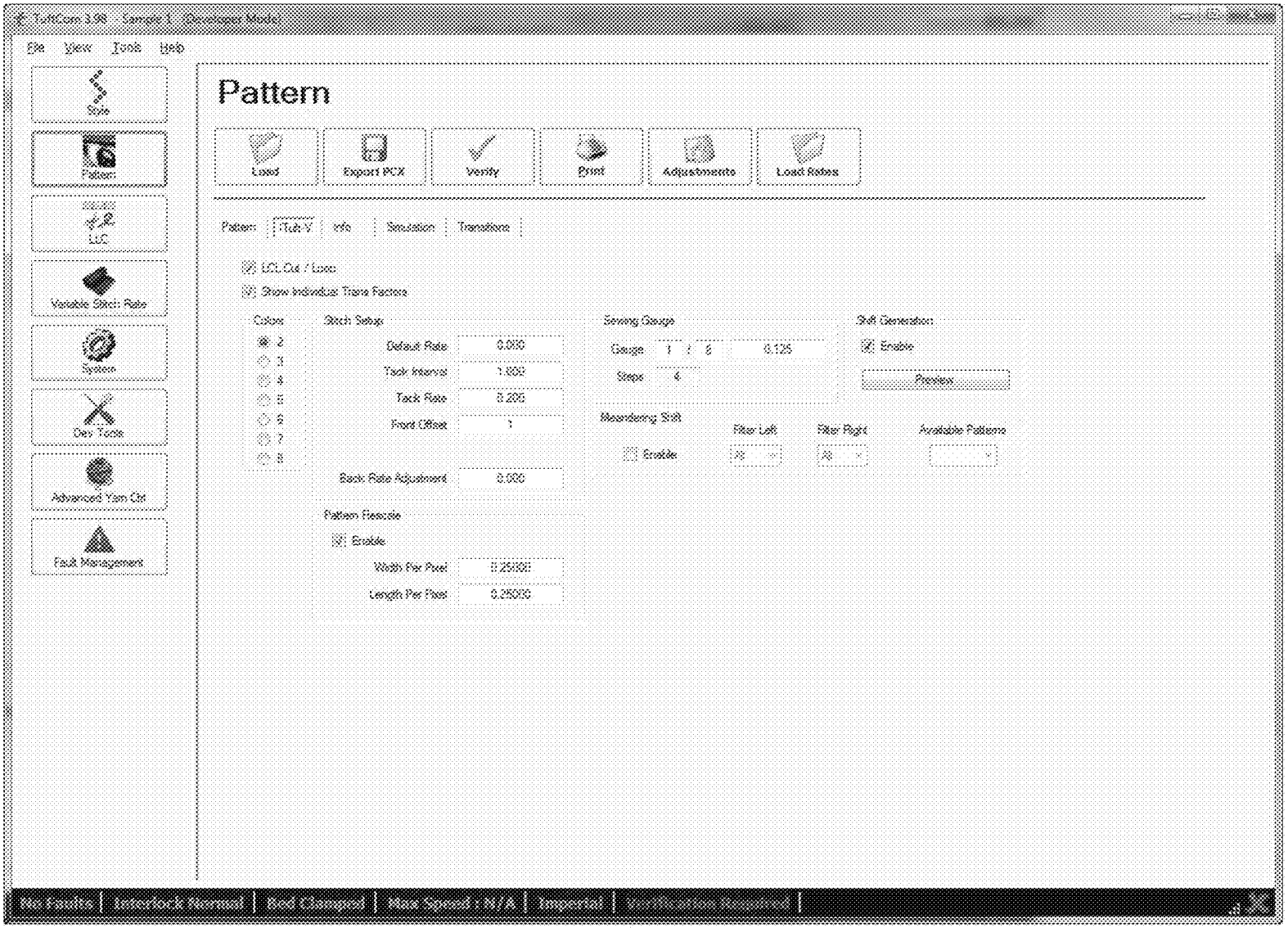
FIG. 12 is an exemplary operator Pattern screen showing pattern input with sewing gauge and step parameters, along with yarn placement stitch parameters.

FIG. 12 shows another exemplary operator screen on which the operator specifies the gauge at which the pattern is desired to be tufted. In this instance, $1/8^{th}$ gauge is specified as the sew gauge indicating the desired apparent gauge for the resulting fabric. This sew gauge may be the same as the machine gauge, or higher or lower depending upon the desired fabric appearance. The number of steps on the operator screen is filled in with the number of penetrations to the next repeat in the yarn thread-up, so in the present example for a two-color yarn thread-up, a multiple of two, in this case four steps, is input. The stitch set up has a default rate entry for stitches that are left on the back of the greige, tacking interval in inches and a tack rate for the yarn feed amount to supply for a tacking stitch. The front offset is simply the row of the pattern that the tufting machine will start on and the actual stitch offset can be calculated automatically by the tufting machine based upon the calculated stitch rate and the needle bar offset that is provided in the machine configuration, for example in the exemplary operator screen of FIG. 11. A pattern rescale changes the pattern to preserve the optical integrity of the original pattern while changing the gauge or density of its stitching. In the example, the pixel size is being specified at 0.25 inches in width and length.

Figure 13:
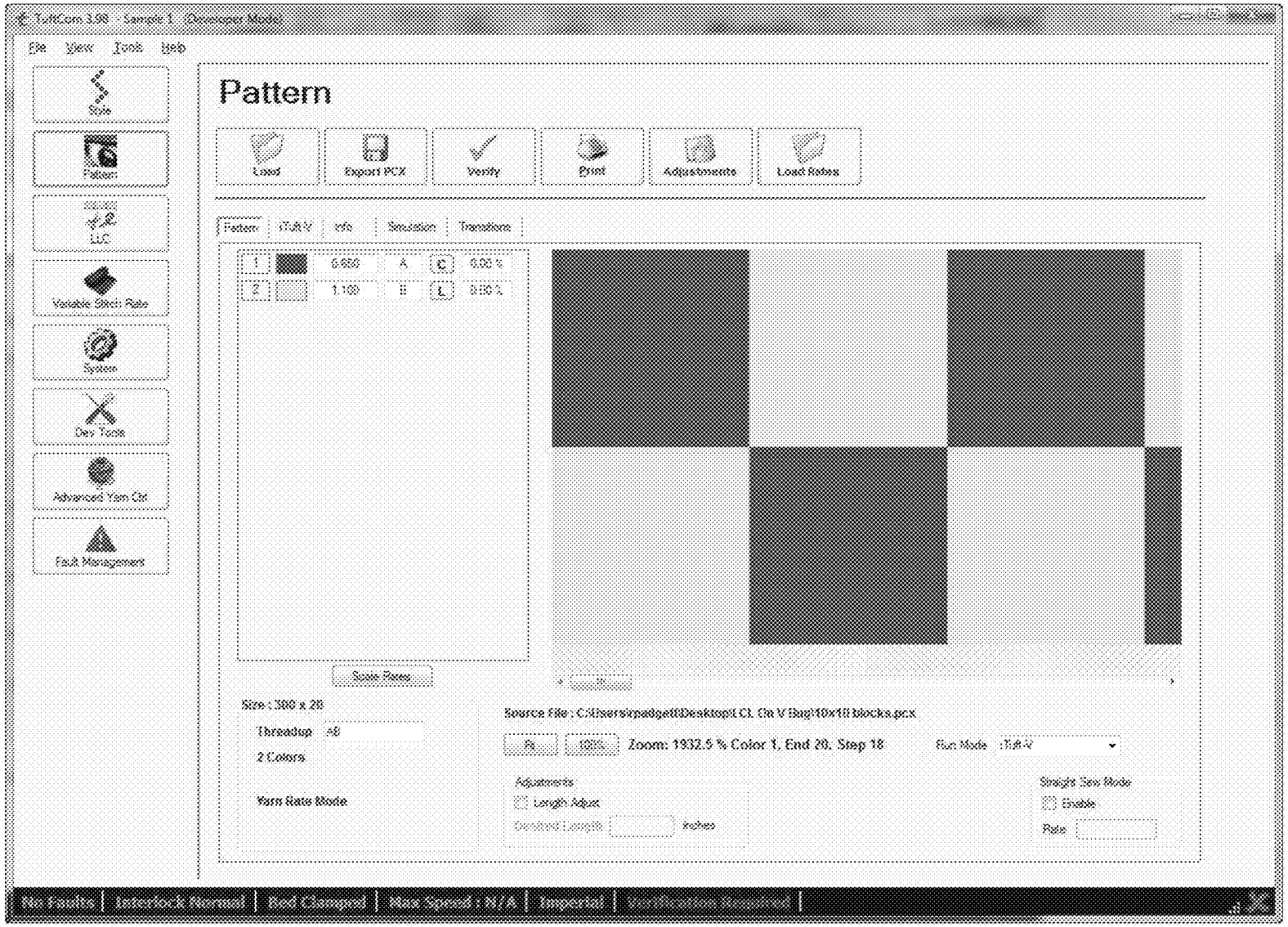
FIG. 13 is an exemplary operator Pattern screen showing yarn thread-up and feed rate inputs together with pattern imagery.

FIG. 13 shows an exemplary operator screen that has a two-color pattern loaded with an AB thread-up and with the tufting machine designated to run a cut/loop apparatus in the variable gauge backing shifting mode described in connection with FIGS. 3 through 6. In the example, yarn feed rates for A and B yarns are specified and the selection of C or L allows the designation of cut or loop yarn bights to be formed by operation of gated hook or similar cut/loop apparatus. The image has a designated size of 300 stitches in width and 20 stitches in height. Since each pixel in FIG. 12 was designed to have 0.25 inch sides, this means that each of the two pixels in the height of the image contains 10 stitches. It is equally possible to utilize the technique in connection with a standard tufting machine configuration that is tufting with the yarn placement techniques of U.S. Pat. Nos. 8,240,263; 9,556,549; 9,663,885; 10,167,585 and their related families of patents. The technique is also useful in working with hollow needle tufting machines and ICN tufting machines. Essentially, the pattern can be designed with a variable gauge backing shifting or with the standard gauge needle bar shifting for the purposes of this scaling method. The technique allows the mapping of the yarn placements for patterns from one gauge to another.

Figure 14:
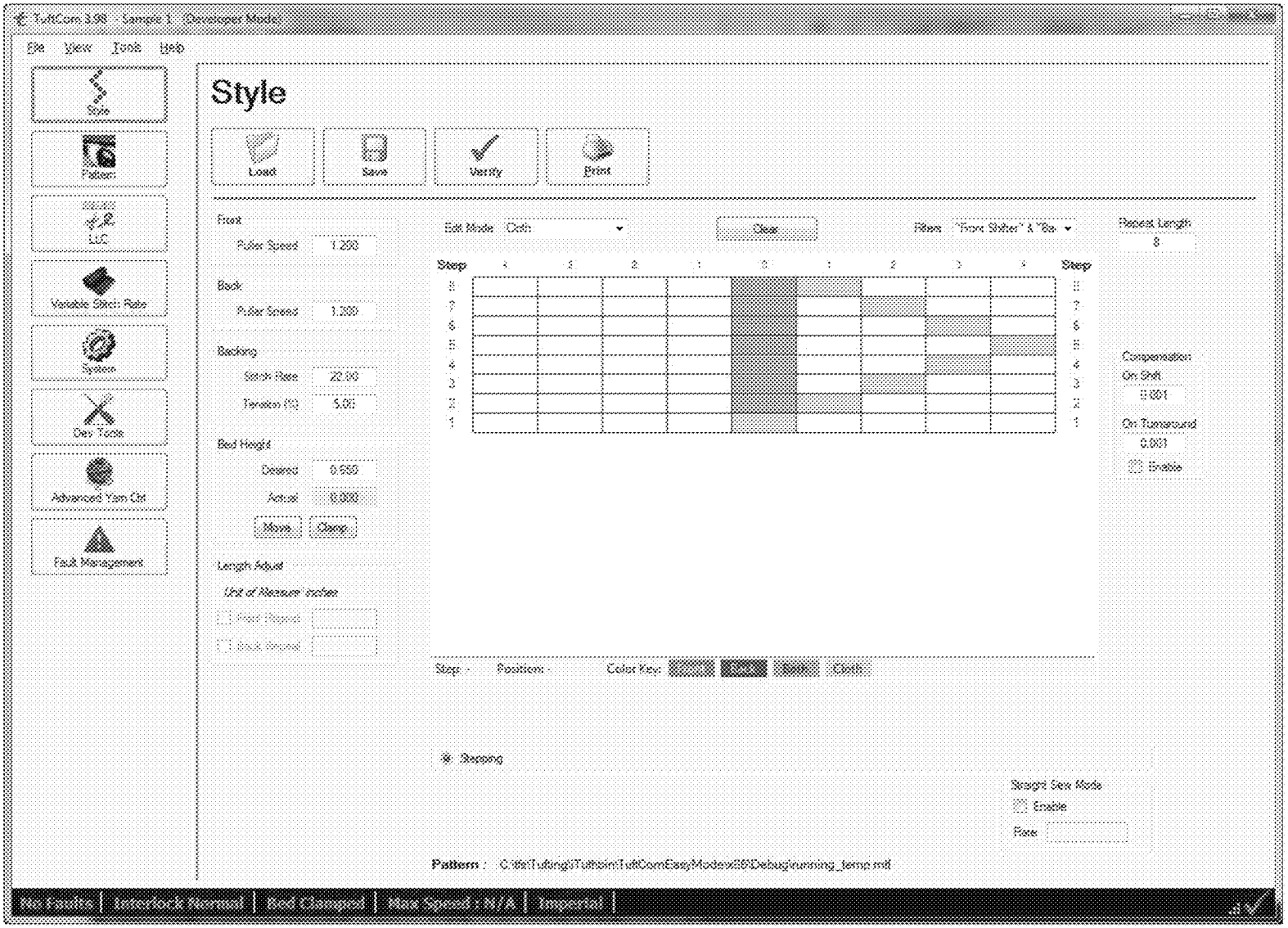
FIG. 14 is an exemplary operator Style screen showing stepping patterns for two needle bars and a backing shifter.

FIG. 14 is an exemplary operator screen showing how a needle bar stepping patterns can be input for front needle bar, back needle bar, both needle bars, or the cloth feed. The cloth feed shifting would be utilized on a pattern operating with the variable gauge backing shifting described in FIGS. 3-6, and also would be typical on hollow needle tufting machines. The filters tab allows for viewing of the stepping pattern of only a selected needle bar or backing shifter and the edit mode is selected for the particular lateral axis that the operator will be entering the shift pattern. Lateral shift patterns may be entered for any combination of needle bars and backing that the tufting machine is equipped to control. The backing stitch rate is the number of stitches that appear longitudinally but in the case of four-color pattern on a conventional tufting machine employing the placement technique of U.S. Pat. No. 8,141,505, actually four times as many stitches per inch are introduced into the backing with three-fourths of those stitches typically removed or tufted at imperceptibly low stitch heights.

Figure 15:
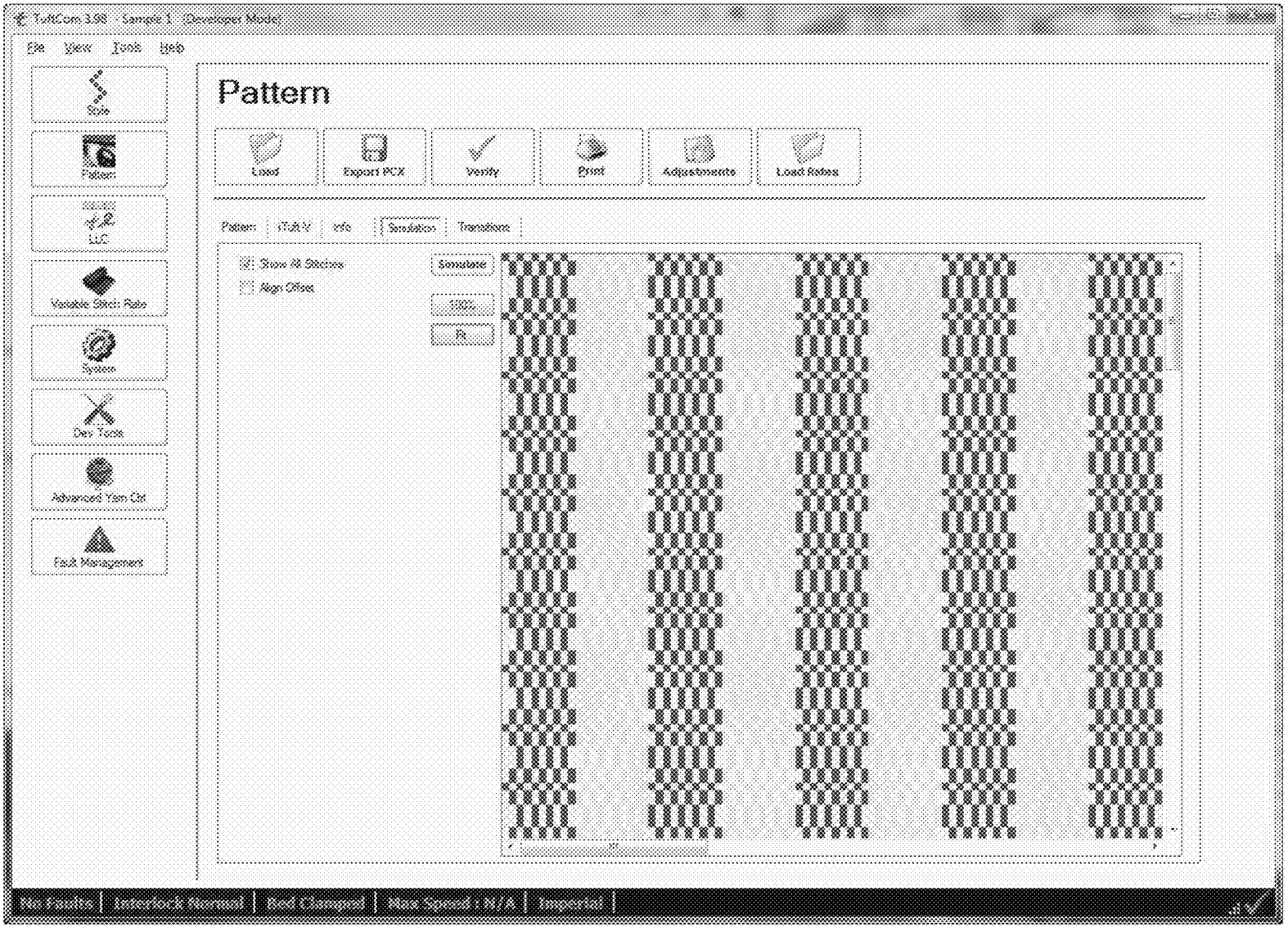
FIG. 15 is a pattern simulation screen to facilitate operator viewing of the input pattern at a stitch by stitch level.

FIG. 15 provides a pattern simulation and allows the viewing of which of the threaded yarns is intended to be prominent on a particular stitch. Every penetration of the needle bar(s) is shown so that the overall length of the simulated pattern with two colors is two times its actual length. The pattern simulation provides a useful debugging tool for operator or designer.

Figure 16:
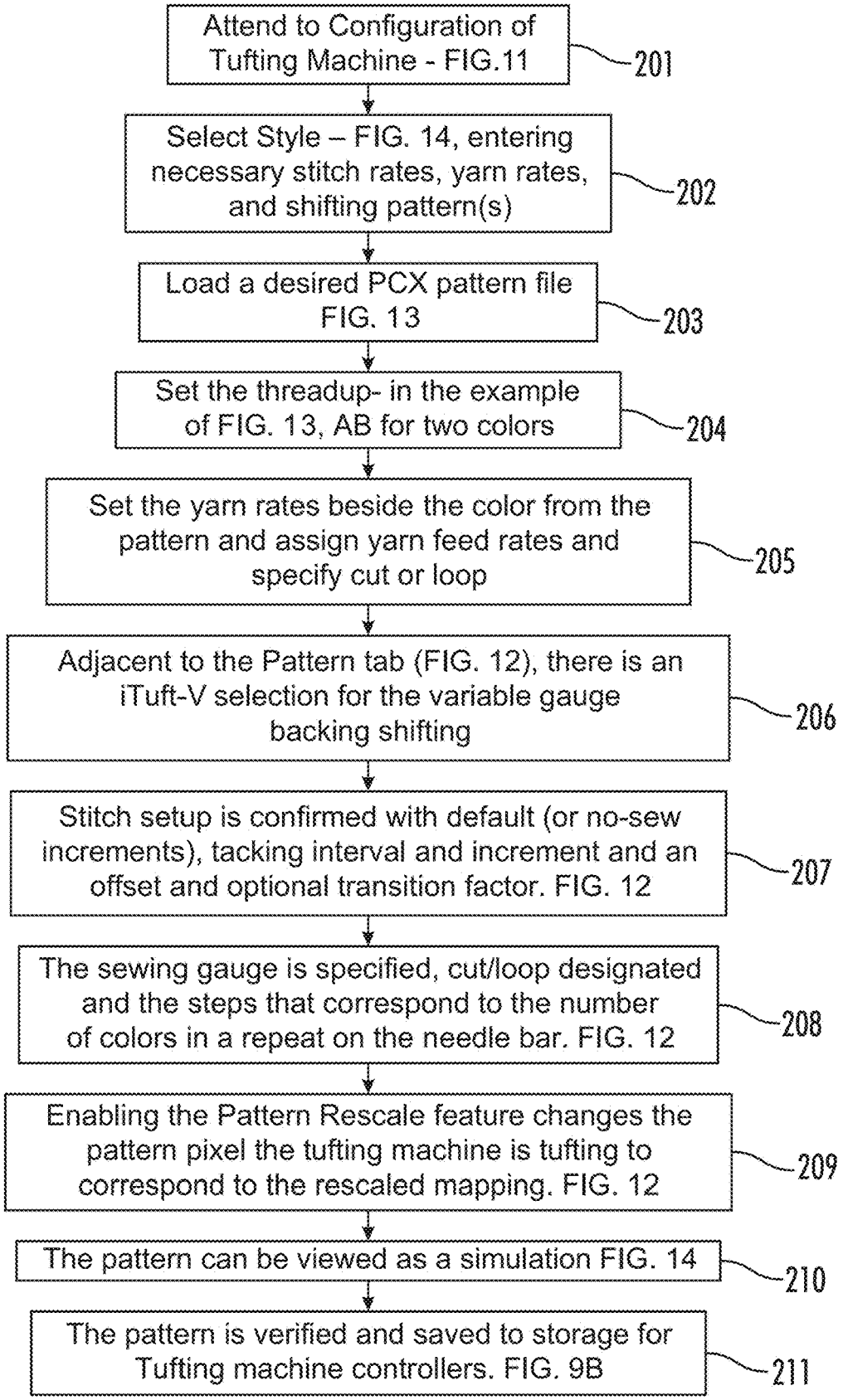
FIG. 16 is a flow chart of pattern manipulation for rescaling.

FIG. 16 provides a schematic illustration of the logic flow that is desired in scaling a pattern. Specifically, the customary preliminary steps are taken where the configuration of the tufting machine is entered into the software 201, 202. For a cut/loop tufting configuration, this feature should be specified so that control information is generated to the apparatus controlling the cut and loop gauge parts. Then a bitmap pattern is loaded 203. The tufting industry presently favors the PCX file format for bitmap files because it has a limited pallet of 256 colors. Thus, the use of the PCX file format assures a limited number of yarn/pile height combinations will be included in a pattern. When the pattern is loaded, the threadup is specified for a conventional (or ICN) tufting machine, generally in an alphabetic sequence corresponding to the number of yarns, i.e. AB for two yarns, ABC for three yarns, ABCD for four yarns. 204. The yarn feed rates are also set 205. There is an option for the type of tufting machine configuration. A single machine could be equipped to operate with variable gauge backing shifting or graphics (or even single) needle bar shifting. Hollow needle or ICN type machines would typically be specified in the configuration setting, as those machine types would be exclusive of certain other alternatives.

The particulars for stitches are confirmed 207, and with single or graphics needle bar yarn placement, this will typically include a yarn feed rate for stitches that are removed from the backing, a yarn feed increment for tacking stitches, and a tacking interval to insure that unused yarns remain bonded to the backing fabric. An offset is specified, which in the illustrated FIG. 12 need only specify the longitudinal row of stitches that the pattern will commence on and the software can compute the pattern offset required by spacing between needle bars based upon machine configuration information. A critical component for rescaling patterns is the specification of a sewing gauge and the number of colors in repeats 208. Sewing gauge can be precisely specified for backing shifting machines as described in connection with FIGS. 3-6 and for hollow needle machines that also frequently utilize backing shifting.

Yarn placement practiced by standard tufting machines in single needle bar, as in U.S. Pat. No. 8,141,505 and continuations, or in graphics configurations, as in U.S. Pat. No. 9,663,885 and continuations, is rarely precisely scalable. Certainly, a fifth gauge ($1/5^{th}$ inch needle spacing) tufting machine can scale precisely to tuft at tenth gauge, however, a tenth gauge single or graphics needle bar machine cannot precisely scale to twelfth gauge—so some approximation is implemented. The pattern is processed to map the pattern pixels to the yarns that the needles will be tufting in the rescaled pattern 209. ICN tufting machines without precision backing shifting are also not precisely scalable apart from similar doubling of the machine gauge. The pattern rescale feature effectively maps the pattern at the size and tuft density that as designed, to the same size in a newly specified tuft density. Without rescaling, transitioning a tenth gauge pattern to twelfth gauge makes the size of the pattern shapes smaller. Thus, without rescaling a twelve-inch-wide rectangle in a pattern at $1/10^{th}$ gauge will be only a ten-inch-wide rectangle at $1/12^{th}$ gauge. Simulations of the pattern in original and rescaled versions, and with stitch by stitch visualizations may be graphically depicted. 210. The rescaled pattern is verified and may be saved for immediate and future use. 211.

The ability to rescale patterns is of increasing importance in a tufting industry driven to operate at maximum efficiency, and numerous applications exist for rescaled patterns. In one example, if a tufting facility has both tenth and twelfth gauge graphics tufting machines and all of the twelfth gauge machines are operating at full capacity while the tenth gauge machines are only operating for a single daily shift, there exists the possibility to rescale some twelfth gauge patterns to tenth gauge and obtain extra production. The resulting rescaled tenth gauge patterns will have the same appearance but a reduced tuft density and resulting cost. The possibility also exists to scale tenth gauge patterns to be tufted on a twelfth gauge machine in a fashion that closely approximates tenth gauge appearance and density. Thus, pattern rescaling allows tufting mills to operate at higher capacity without the necessity of changing out all of a tufting machine's gauge parts and reconfiguring the machine. A tufting machine with variable backing shifting can with a fair degree of precision emulate the gauge and appearance of shifted single needle bar or graphics tufting machines of a variety of gauges.

Also, to optimize carpet costs, a fabric with the same appearance can be offered at a variety of densities that can be selected according to their intended use. So, for instance a residential use or even use in a hotel room may be entirely suitable with a lower density than carpet designed for use in a hotel lobby or hallway. Similarly, a manufacturer can offer carpet tiles of the same pattern in different densities at different price points.

When tufting fabrics utilizing two needle bars, most commonly two offset $1/5^{th}$ gauge needle bars (with needles spaced every 0.20 inches along each needle bar) the needle bars are staggered relative to one another to create a composite $1/10^{th}$ gauge arrangement. In this instance, typically each 1/5th gauge needle bar cooperates with one row of $1/5^{th}$ gauge yarn seizing parts in the form of loopers or hooks that seize the yarn carried through the backing fabric. An advantage provided by the use of laterally shifting needle bars together with laterally shifting backing fabric, is the possibility to provide stitch placements at lateral increments different than the needle bar gauge. So, for instance, the rear needle bar can remain stationary while the backing fabric is laterally shifted in $1/10^{th}$ of an inch increments on successive stitches. In addition, the needle bar can be threaded with different colors of yarn, for example purple A-threads and orange B-threads and either yarn can be placed within $1/10^{th}$ of an inch laterally from the other yarn when the backing fabric is shifted by $1/10^{th}$ of an inch, rather than the $1/5^{th}$ of an inch spacing that would be dictated by only being able to shift the needle bar. The advantages provided by the reduced lateral shifting distances include yarn saving and a higher percentage of yarn appearing on the face of the greige rather than placed on the back of the backing fabric where it can neither be seen nor contribute to the wear characteristics of the fabric.

The introduction of both needle bar and backing fabric shifting complicates patterning as may be illustrated in connection with FIGS. 17-21. This stitch visualization 321 in FIG. 17 reflects yarn penetrations made by two offset shifting needle bars, each needle bar being $1/5^{th}$ inch gauge in a staggered alignment creating a composite $1/10^{th}$ gauge tufting machine with a 0.25 inch longitudinal offset between the front and year needle bars. The stitch visualization is shown with A B & C yarns 302,304,306 respectively, threaded on the front needle bar and A B & C yarns 303,305,307 respectively threaded on the rear needle bar. The backstitch connection between the rear needle bar yarn stitches is shown in dashed lines while the connection between stitches on the front needle bar are shown in solid lines. In the illustrated visualization, as the backing fabric moves from top to bottom beneath the needles, the backing fabric is being shifted two sequential steps to the right, then three sequential steps to the left, then four sequential steps to the right, and three sequential steps to the left to complete a stitch sequence. The stitch rate has been specified as thirty stitches per inch, so slightly more than seven stitches by the front needle bar are required to reach the position where the rear needle bar began penetrating the backing fabric at startup to account for the quarter inch longitudinal separation between the needle bars.

Figure 17:
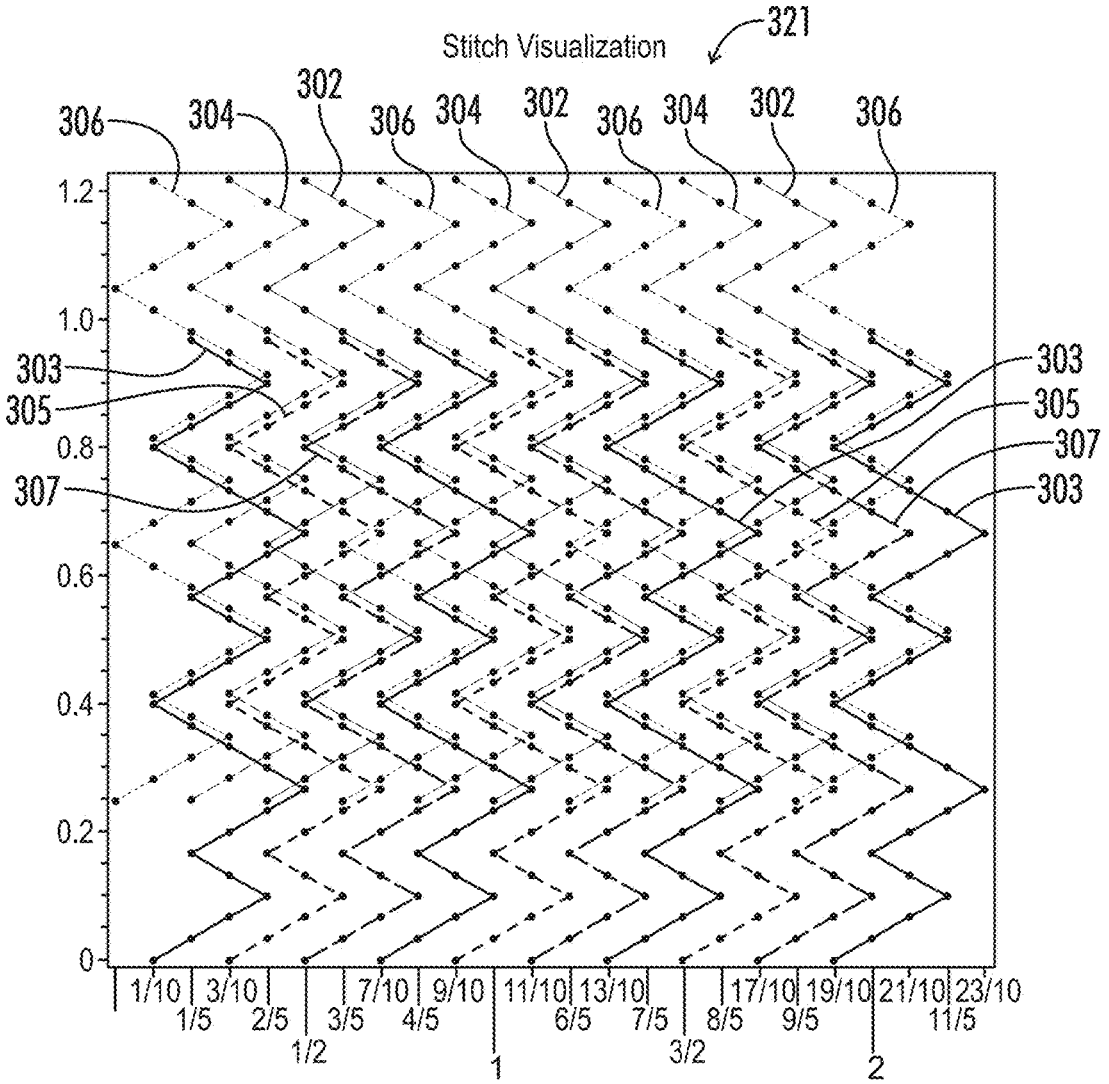
FIG. 17 is a stitch visualization of yarn placements on a two needle bar tufting machine with staggered gauge parts.
Figure 18:
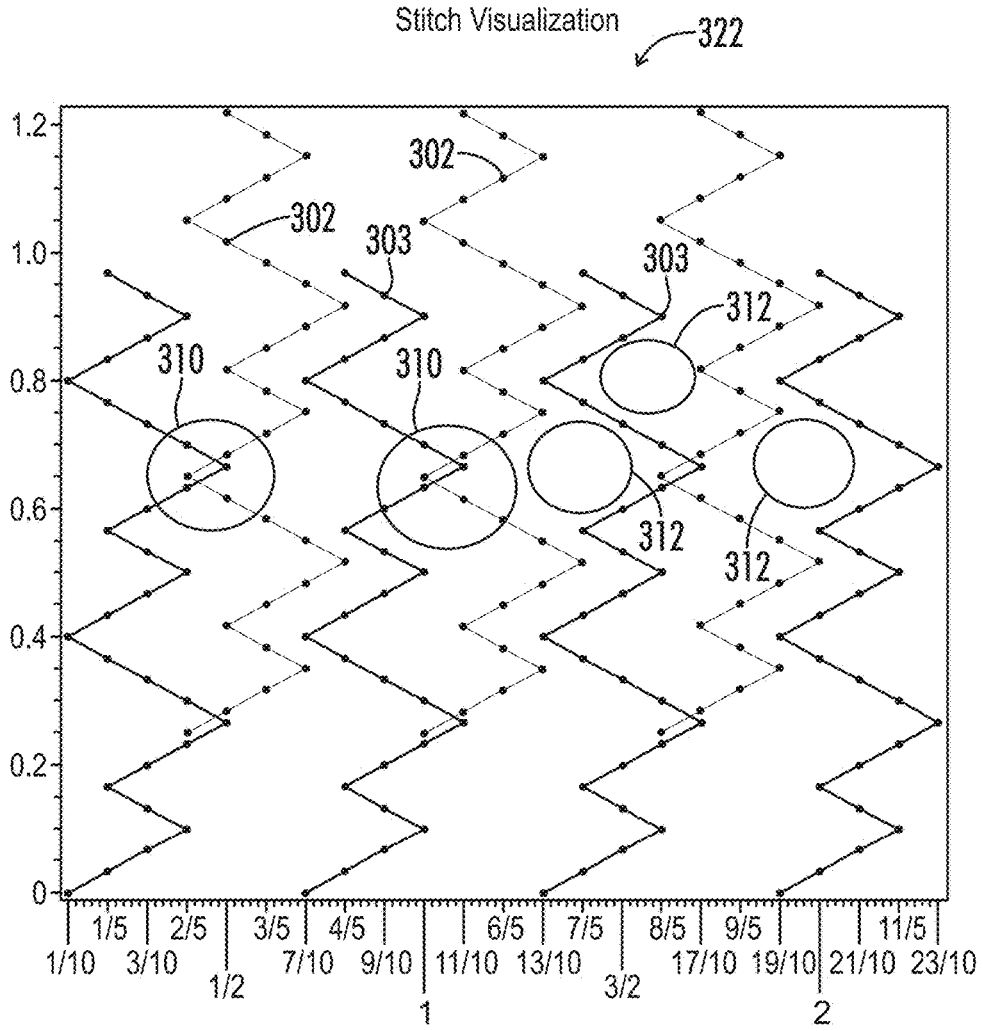
FIG. 18 is a stitch visualization of the placements of a single yarn from each of the front and rear needle bars of the shift pattern shown in FIG. 17.

For ease of examination, only the front and rear A-color yarns 302,303 are shown in the stitch visualization 322 of FIG. 18. This is useful because it illustrates the proximity with which the A-color yarn from the front needle bar 302 and A-color yarn from the rear needle bar 303 can be placed. As is apparent in the visualization, there are some areas with numerous closely spaced penetrations as illustrated in circles 310 and other areas with an absence of penetrations of the A yarns 302,303 as for example the circles 312. Such a stitch penetration pattern creates an increased likelihood of over tufting in crowded zones such as 310 and the possibility of a noticeably thin carpet face in zones without good penetration density such as 312. In stitch visualization 323 of FIG. 19 an optimal stitch placement of front A-color yarns 302 and rear A-color yarns 303 is shown. Again, the B and C-color yarns are removed for a simplified illustration. This optimal stitch placement is readily achieved when the needle bars are threaded with an even number of yarns or when the stitch rate aligns with the lateral offset between needlebars. However, with three yarns and a stitch rate of 30 stitches per inch (or about 0.0333 inches advanced longitudinally per needlebar reciprocation, there is an imperfect alignment of front needlebar stitching and rear needlebar stitching giving rise to the crowded and sparse stitch zones 310, 312 of FIGS. 17 and 18.

Figure 19:
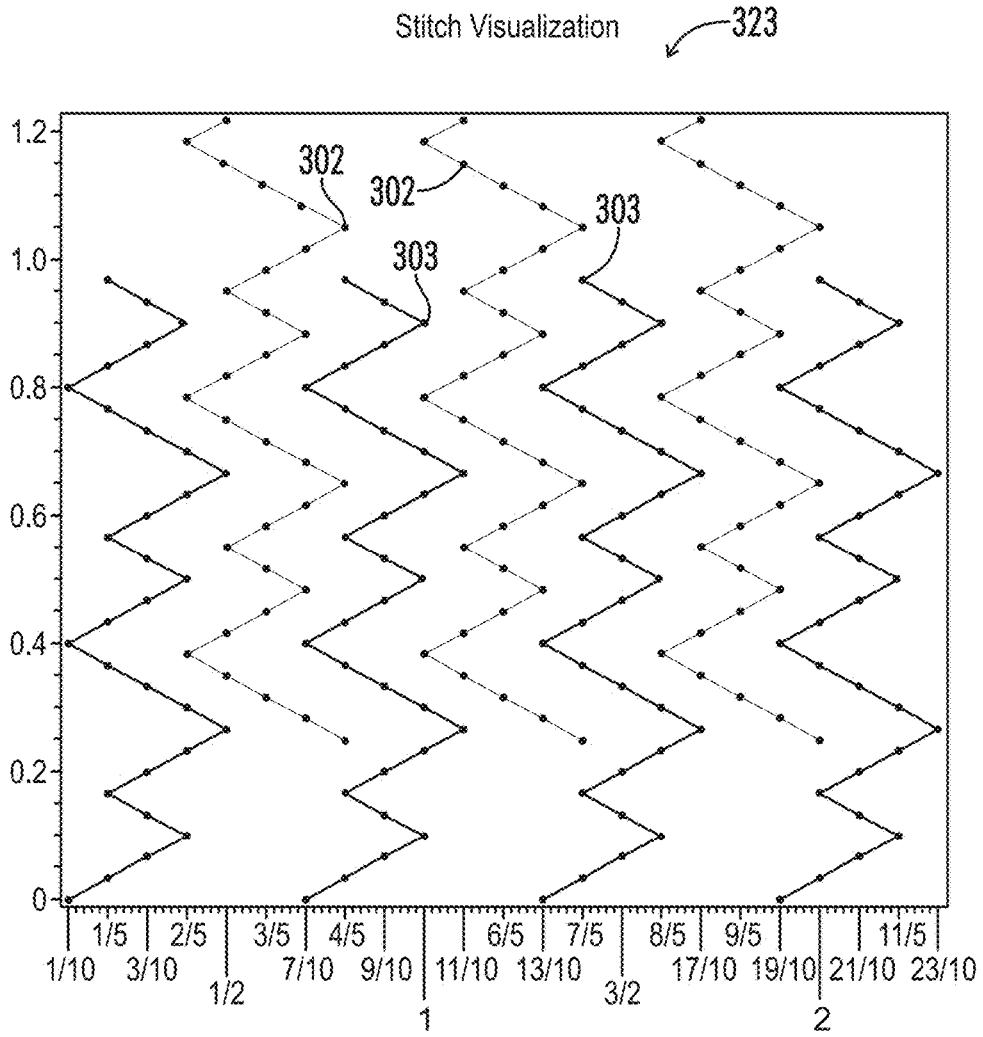
FIG. 19 is an optimized stitch placement visualization for a single yarn from each of the front and year needle bars with both backing fabric and independent needle bar shifting.

In FIG. 19, the cloth shift has been changed from the 2, 3, 4, 3 right-left shift pattern described in FIGS. 17 and 18 to a simple left-right repeat. In addition, the shifts in this instance, the pattern is actually calculated using a combination of the cloth shift in positions zero and one representing center and offset one shift 1/10 of an inch to the right. The stitch visualization 323 shows the intended shift of three to the right, two to the left, three to the right, and four to the left as in FIGS. 17 and 18. However, the shifting of front and rear needle bars is optimized to produce relatively uniform stitch placement of the A yarns by positioning the yarn penetrations from the front and rear needle bars intermediate one another relatively precise alignment. The optimization involves calculating a stitch offset to compensate for the longitudinal offset spacing between the front and rear needlebar, typically 0.25 inches. If the stitch rate were 20 stitches per inch, then each stitch cycle would advance by 0.05 inches and five stitches would be required to cover the 0.25 inch longitudinal offset spacing Since the gauge spacing of each needlebar is typically twice the composite machine gauge, the number of stitches required to tuft the longitudinal offset is rounded to the nearest multiple of two in order to determine the optimal stitch offset in the pattern between the front and rear needlebars. In the example of FIG. 19, the stitch rate of 30 stitches per inch requires 7.5 stitches to tuft the 0.25 inch lateral offset, so this is rounded to 8 stitches for the stitch advance. Then, in the event that the sew gauge is neither the same as the machine gauge, the lateral position of the needle bar is calculated based upon both the lateral shift position of the backing fabric and the lateral shift position of the needlebar. The result is the visualization 323 of FIG. 19. In the event that the sew gauge is both different than the machine gauge and not a multiple of the machine gauge, then there will most frequently not be a perfectly aligned needle position, and a rounding algorithm will be applied resulting in front and rear needle placements akin to that shown in the visualization 325 of FIG. 21. In this fashion, with backing shifting, and each needlebar shifting with the same odd number of different yarns, there are neither crowded zones of yarn penetrations nor sparse zones without sufficient yarn penetrations as was the case in zones 310,312 of FIG. 18.

Figure 20:
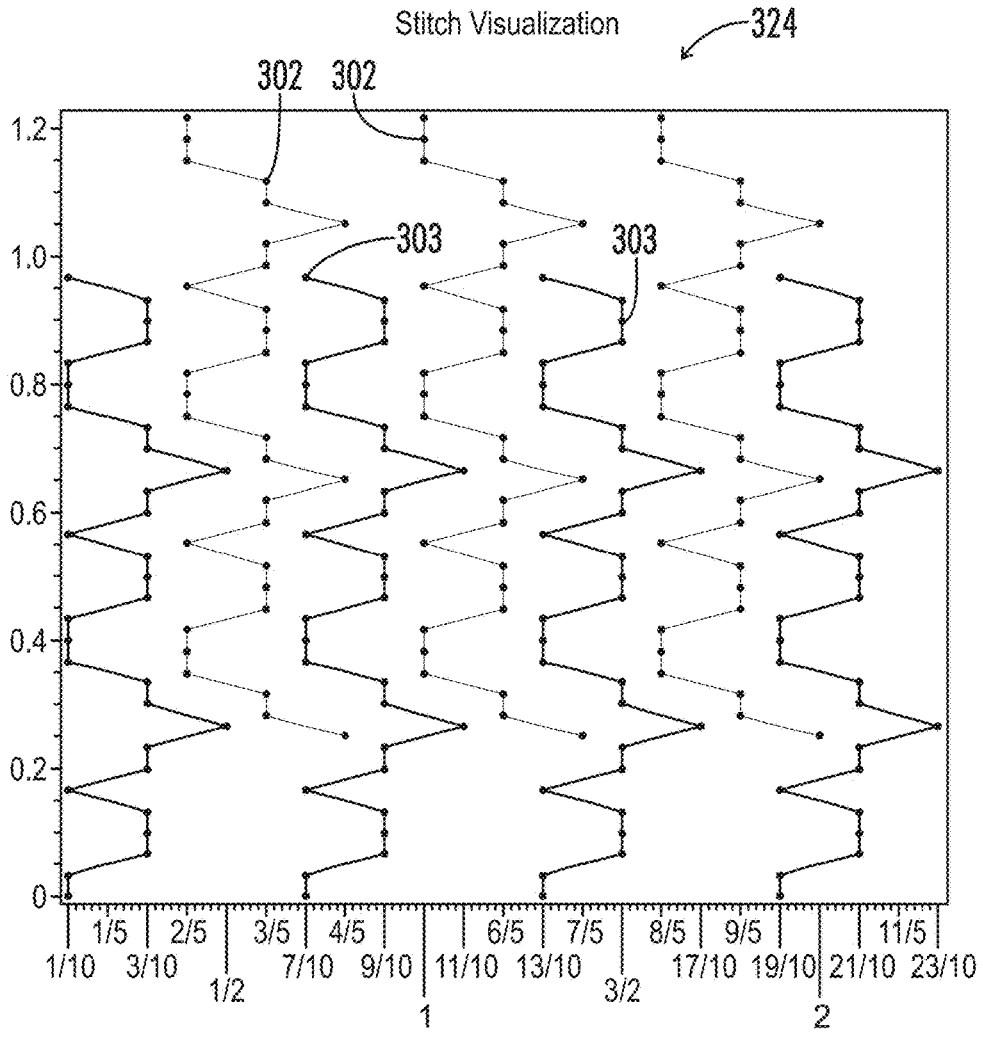
FIG. 20 is a stitch placement visualization of the shift pattern disclosed in FIG. 19 for only the needle bars, as would be the result if the backing fabric were maintained in a fixed lateral position.

FIG. 20 in stitch visualization 324 shows the actual shifts of only the needle bars without factoring in the backing fabric shift, that will actually result in the desired two right, three left, four right, three left stitching sequence when the backing fabric shift cycle is included. In the visualizations of FIGS. 17-21, the simple left-right shift sequence of a composite gauge distance of 0.10 inches is used as it is sufficient to allow each fifth gauge needlebar to place yarns at tenth gauge increments. More complex shift sequences could be used for the backing fabric, and these alternatives might prove desirable for particular combinations of sew gauge and number of colors of yarn in patterns on a tufting machine of a particular machine gauge.

Figure 21:
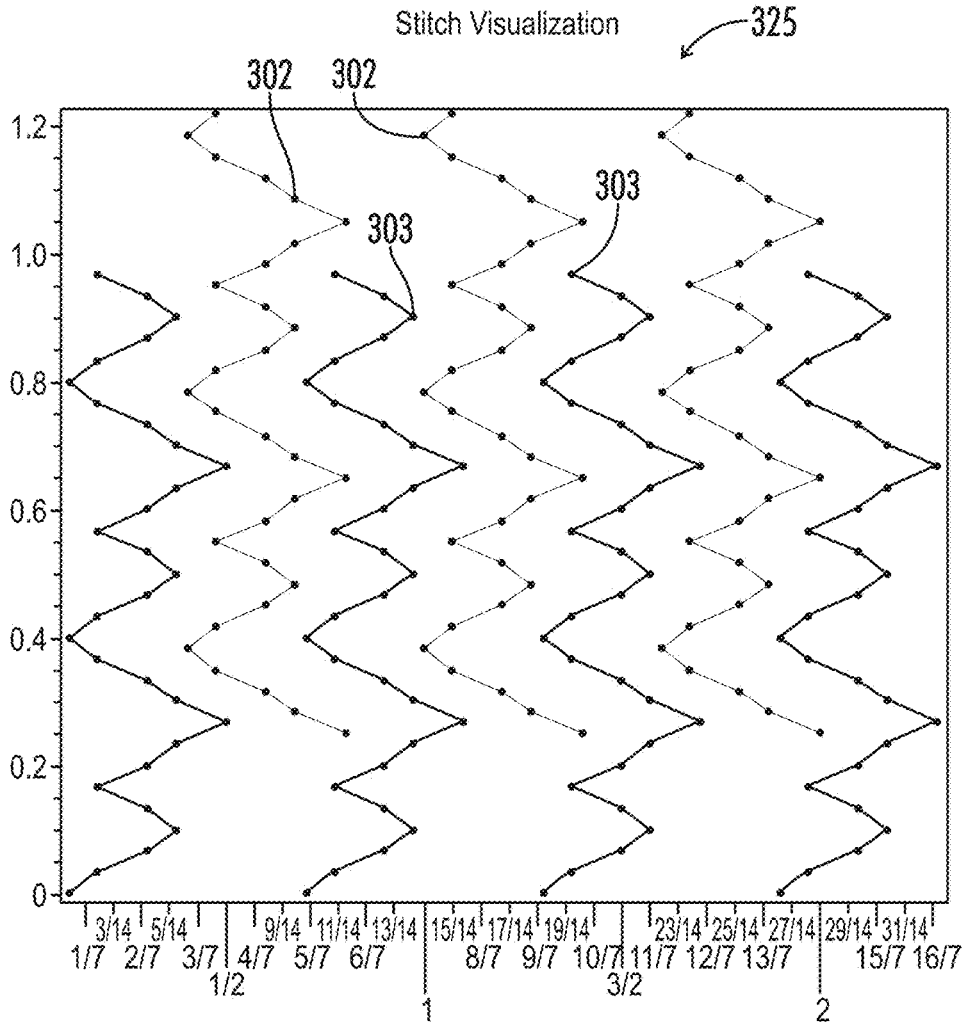
FIG. 21 is a stitch visualization of a three-axis optimized shift pattern with a different sew gauge than the machine gauge of the applicable tufting machine, employing rounding for stitch location optimization.

Because of the fashion in which stitch placements are located, it is also possible to utilize the patterning capability to have a sewing gauge for the pattern that is different from the machine gauge. As mentioned above, in the instance of sew gauge differing from the machine gauge, the patterning software often has to accomplish some approximations in choosing stitch placement locations. The stitch visualization 325 of FIG. 21 provides an example for A-colored yarns 302,303 on the same $1/5^{th}$ and $1/5^{th}$ gauge two needle bar alignment that results in a $1/10^{th}$ composite machine gauge. In the stitch visualization 325, the pattern is specified at a $1/14^{th}$ sew gauge. It can be seen that the stitch placements for A-colored yarns 302,303 are not as precisely spaced as when the sew gauge and machine gauge are the same or an exact multiple. However, the approximations shown in visualization 325 are remarkably close to the idealized yarn placement positions. As is the case with pattern scaling, approximation techniques and algorithms such as round mid-to-even, round up, round down, and round mid-away-from-zero can be used to select the best approximations.

Considerations of over sewing and areas having too few yarn penetrations of a particular color are not typically issues in single needlebar tufting. However, even in those configurations, the lateral movement of both the needlebar and the backing fabric may be employed. This presents particular advantages in situations where the needlebar shift pattern employs jumps of more than one gauge unit. In such a case, the position of a color of yarn might be moved two gauge units with the movement being divided between the needlebar and the backing fabric. Because of the reduced distance being traveled by each of the needles and the backing fabric during the shift window, the movement may either be accomplished at higher tufting machine operating speeds or with less driving force, or both, than would be the case if all of the movement were effected by only the needles or only the backing fabric.

A critical modification in using both backing fabric shifting and needlebar shifting is determining yarn position not by needle bar location alone nor by backing fabric location alone. Instead, the position of a particular yarn carrying needle is determined by a combination of the particular location of the needle on the needle bar, the shifted location of the needlebar, and the shifted location of the backing fabric. The result is that in the setting of Style, as depicted in FIG. 14, the entry of shifting patterns is more complex and will involve both a needle bar, or two, and the backing fabric shifting. In the event of Pattern Rescale, the details to accomplish the desired shift pattern may be slightly modified and rounded to the closest available needle penetration locations so that the shift pattern is not exactly the same as when the tufting machine forms patterns in the machine gauge. When the Pattern Rescale feature is employed, the tufting machine uses shifted needle location and shifted backing fabric location to determine where the corresponding yarn carried by a particular needle is placed in the rescaled mapping of the pattern. Even without rescaling, the pattern generation process considers both the shifted needlebar position and the shifted backing fabric position to determine the pattern pixel that a particular needle penetration corresponds to. In the two needlebar setup, accommodations are also made for the longitudinal offset between needlebars. The calculation of both lateral needle position and lateral backing fabric position in translating pattern pixels to sewing locations represents a further complexity and enhancement of tufting capabilities.

Numerous alterations of the structure herein described will suggest themselves to those skilled in the art. It will be understood that the details and arrangements of the parts that have been described and illustrated in order to explain the nature of the invention are not to be construed as any limitation of the invention. All such alterations which do not depart from the spirit of the invention are intended to be included within the scope of the appended claims.

What is claimed is:

1. A method of reducing the frequency of oversewing tufts when operating a tufting machine for forming tufted fabrics of the type having:

a first needle bar and a second needle bar, each having a series of needles mounted transversely across the width of the tufting machine;

a yarn feed mechanism for feeding a series of yarns to said needles, the yarns being carried by said needles;

a needle drive for reciprocating the yarn carrying needles through a backing material;

backing feed rolls for feeding the backing material through a tufting zone of the tufting machine;

a first shifter to move needles of the first needle bar laterally;

a second shifter to move needles of the second needle bar laterally;

a series of gauge parts mounted below the tufting zone in a position to engage yarns carried by needles as the needles are reciprocated into the backing material to form tufts of yarns in the backing material;

a control system for controlling and synchronizing the first and second shifters, the needle drive, the backing feed rolls, the gauge parts, and a needle plate reciprocation;

comprising the steps of determining when yarns tufts of yarns caried by the needles of the first needle bar are likely to be oversewn by the needles of the second needle bar, and causing the needles of the second needle bar to be marginally shifted on at least selected reciprocations to lessen over sewing yarn tufts of yarns carried by the needles of the first needle bar.

2. The method of claim 1 wherein the tufting machine further comprises a shifter to move the backing material laterally.

3. The method of claim 2 wherein the first and second needle bars have a gauge and are staggered to create a composite gauge that is the machine gauge and the tufting machine is operated to create patterns with a sew gauge distinct from the machine gauge.

4. The method of claim 3 wherein the first needle bar and the second needle bar are longitudinally spaced from each other by a longitudinal offset distance, and a stitch advance to cover the longitudinal offset distance is calculated.

5. The method of claim 2 wherein the tufting machine is operated to create fabrics of different gauges but otherwise similar appearance from a same pattern.

6. A method of altering the needle penetration locations of a yarn placement pattern for a tufting machine having a first needle bar with a needle gauge and a shifter for laterally positioning and displacing the first needle bar and having a second shifter for laterally positioning and displacing a backing fabric fed through the tufting machine, comprising the steps of inputting a bitmap pattern file for a tufting machine pattern at a first gauge including some cut pile tufts of yarn;

inputting yarn feed rates, yarn threadup information sufficient to identify a number of different yarns used in the pattern and locations of the different yarns with respect to specific needles, and shifting patterns for the first needle bar and the backing fabric;

specifying the gauge at which the tufting machine tufts;

specifying a second gauge for tufting the pattern;

mapping the location of yarn carrying needles at the second gauge to the pattern at the first gauge based upon lateral displacements of both the first needle bar by the first shifter and the backing fabric by the second shifter;

selecting yarns to tuft at the second gauge based upon said mapping.

7. The method of claim 6 wherein the tufting machine further comprises a second laterally shiftable needle bar and mapping locations of yarn carrying needles based upon lateral displacements of the first needlebar, the second needlebar and the backing fabric.

8. The method of claim 7 wherein the needles of the second needle bar are marginally shifted to minimize over sewing yarn tufts of yarns carried by the needles of the first needle bar.

9. The method of claim 7 wherein the needles of the first and second needlebars are threaded with a repeating sequence of an odd number of different yarns.

10. The method of claim 7 wherein the first needle bar and the second needle bar are longitudinally spaced from each other by a longitudinal offset distance and a stitch advance to cover the longitudinal offset distance is calculated as a part of mapping the locations of the yarn carrying needles.

11. A method of reducing the frequency of oversewing tufts when operating a tufting machine for forming tufted fabrics of the type having:

a first needle bar and a second needle bar longitudinally spaced from each other by a longitudinal offset distance, and each having a series of gauge spaced needles mounted transversely across the tufting machine;

a yarn feed mechanism for feeding a series of yarns to said needles, the yarns being carried by said needles;

a needle drive for reciprocating the yarn carrying needles through a backing material;

backing feed rolls for feeding the backing material through a tufting zone of the tufting machine and a backing shifter to laterally move and position the backing material;

a first shifter to move needles of the first needle bar laterally;

a second shifter to move needles of the second needle bar laterally;

a series of gauge parts mounted below the tufting zone in a position to engage yarns carried by needles as the needles are reciprocated into the backing material to form tufts of yarns in the backing material;

a control system for controlling and synchronizing the first, second and backing shifters, the needle drive, the backing feed rolls, the gauge parts, and a needle plate reciprocation;

wherein the needles of the first and second needlebars are threaded with a repeating sequence of an odd number of different yarns, and wherein the first and second needle bars have a composite gauge that is the machine gauge and comprising the steps of laterally shifting the backing material in units of the machine gauge between reciprocations of the yarn carrying needles and laterally shifting each of the first and second needlebars in units of their respective needle gauge spacing between reciprocations of the yarn carrying needles.

12. The method of claim 11 wherein the needles of the second needle bar are marginally shifted to minimize over sewing yarn tufts of yarns carried by the needles of the first needle bar.

13. The method of claim 11 wherein the odd number of different yarns is three different yarns.

14. The method of claim 11 wherein the tufting machine is operated to create patterns with a sew gauge distinct from the machine gauge.

15. A method of reducing the frequency of oversewing tufts when operating a tufting machine for forming tufted fabrics of the type having:

a first needle bar and a second needle bar longitudinally spaced from each other by a longitudinal offset distance, and each having a series of gauge spaced needles mounted transversely across the tufting machine;

a yarn feed mechanism for feeding a series of yarns to said needles, the yarns being carried by said needles;

a needle drive for reciprocating the yarn carrying needles through a backing material;

backing feed rolls for feeding the backing material through a tufting zone of the tufting machine and a backing shifter to laterally move and position the backing material;

a first shifter to move needles of the first needle bar laterally;

a second shifter to move needles of the second needle bar laterally;

a series of gauge parts mounted below the tufting zone in a position to engage yarns carried by needles as the needles are reciprocated into the backing material to form tufts of yarns in the backing material;

a control system for controlling and synchronizing the first, second and backing shifters, the needle drive, the backing feed rolls, the gauge parts, and a needle plate reciprocation;

wherein the first and second needle bars have a composite gauge that is the machine gauge and comprising the steps of laterally shifting the backing material in units of the machine gauge between reciprocations of the yarn carrying needles and laterally shifting each of the first and second needlebars in units of their respective needle gauge spacing between reciprocations of the yarn carrying needles; and wherein the shifting of the needlebars is calculated with a stitch advance for an even number of stitches to cover the longitudinal offset distance between the first and second needlebars.

16. The method of claim 15 wherein the needles of the second needle bar are marginally shifted to minimize over sewing yarn tufts of yarns carried by the needles of the first needle bar.

17. The method of claim 15 wherein the needles of the first and second needlebars are threaded with a repeating sequence of an odd number of different yarns.

18. The method of claim 17 wherein the odd number of different yarns is three different yarns.

19. The method of claim 15 wherein the tufting machine is operated to create patterns with a sew gauge distinct from the machine gauge.

* * * * *